US008640296B2

(12) United States Patent
Weaver et al.

(10) Patent No.: US 8,640,296 B2
(45) Date of Patent: Feb. 4, 2014

(54) ADJUSTABLE CLEANING HEAD FOR A CLEANING TOOL

(75) Inventors: Jace A. Weaver, Gilbertsville, PA (US); Ryan Sheckels, Marlton, NJ (US); Sean E. Monahan, Franklinville, NJ (US); Michael A. Schiavo, Mt. Ephraim, NJ (US)

(73) Assignee: Quickie Manufacturing Corporation, Cinnaminson, NJ (US)

( * ) Notice: Subject to any disclaimer, the term of this patent is extended or adjusted under 35 U.S.C. 154(b) by 207 days.

(21) Appl. No.: 12/987,239

(22) Filed: Jan. 10, 2011

(65) Prior Publication Data

US 2011/0167583 A1 Jul. 14, 2011

Related U.S. Application Data

(60) Provisional application No. 61/293,744, filed on Jan. 11, 2010, provisional application No. 61/312,348, filed on Mar. 10, 2010.

(51) Int. Cl.
*A47L 13/46* (2006.01)

(52) U.S. Cl.
USPC ..... 15/231; 15/208; 15/209.1

(58) Field of Classification Search
USPC ..... 15/208, 209.1, 231
See application file for complete search history.

(56) References Cited

U.S. PATENT DOCUMENTS

| | | | | |
|---|---|---|---|---|
| 3,085,271 | A | 4/1963 | Janssen | |
| 4,845,800 | A * | 7/1989 | Pederson et al. | 15/228 |
| 4,881,290 | A | 11/1989 | Bohacek | |
| 5,161,279 | A | 11/1992 | Sager et al. | |
| 5,864,914 | A * | 2/1999 | Salmon | 15/147.2 |
| 5,943,727 | A | 8/1999 | Freer | |
| 5,970,567 | A | 10/1999 | Hirse | |
| 6,061,864 | A | 5/2000 | Ensson | |
| 6,591,442 | B2 | 7/2003 | Kaminstein | |
| 6,976,282 | B2 | 12/2005 | Sie | |
| D579,165 | S | 10/2008 | Handy et al. | |
| 2002/0138934 | A1 | 10/2002 | Petner et al. | |
| 2002/0174502 | A1 * | 11/2002 | Cioci | 15/119.2 |
| 2004/0071490 | A1 * | 4/2004 | Vosbikian et al. | 401/49 |
| 2006/0048318 | A1 * | 3/2006 | Goh et al. | 15/97.1 |
| 2006/0085935 | A1 * | 4/2006 | White, II | 15/228 |
| 2006/0130255 | A1 | 6/2006 | Horian | |
| 2007/0136973 | A1 * | 6/2007 | Patel et al. | 15/228 |
| 2008/0222825 | A1 | 9/2008 | Sampaio | |

* cited by examiner

*Primary Examiner* — Lee D Wilson
*Assistant Examiner* — Shantese McDonald
(74) *Attorney, Agent, or Firm* — Gregory J. Winsky; Jason F. Cotter; Archer & Greiner, P.C.

(57) ABSTRACT

A cleaning tool is provided and includes a cleaning head moveable between a plurality of configurations. The cleaning head may include a main panel, a handle coupled to the main panel via a universal joint, a first side panel pivotally coupled to a first edge of the main panel, and a second side panel pivotally coupled to a second edge of the main panel opposite the first edge. The cleaning tool may also include two biasing members for biasing the first and second panels toward a flat position and at least one ramp member engageable with a surface to pivot at least one of the first and second side panels upward out of its flat position toward an upward pivoted position. The cleaning tool may further include an actuator for pivoting one or more of the side panels between flat and upward pivoted positions, and a selectively deployable scrubber.

17 Claims, 25 Drawing Sheets

ADJUSTABLE CLEANING HEAD FOR A CLEANING TOOL

CROSS REFERENCE TO RELATED APPLICATION

The present application claims the benefit of U.S. Provisional Patent Application No. 61/293,744, filed Jan. 11, 2010 and U.S. Provisional Patent Application No. 61/312,348, filed Mar. 10, 2010, both of which are incorporated herein in their entirety by reference thereto.

FIELD OF THE INVENTION

The present invention generally relates to cleaning tools and, more particularly, to cleaning tools having an adjustable cleaning head.

SUMMARY OF THE INVENTION

In one example, a cleaning tool including an adjustable cleaning head is provided.

In another example, a cleaning tool is provided and includes a cleaning head adjustable between multiple configurations.

In yet another example, a cleaning tool is provided and includes a cleaning head having a plurality of panels selectively moveable relative to each other.

In still another example, a cleaning tool is provided and includes a cleaning head having a plurality of panels selectively moveable relative to each other and at least one of the panels includes a ramp member to facilitate movement of the at least one panel relative to the other panel(s).

In a further example, a cleaning tool is provided and includes a cleaning head having a plurality of panels selectively pivotal relative to each other between a flat position and an upward pivoted position. The cleaning head also includes a biasing member biasing at least one of the panels from the upward pivoted position toward the flat position.

In yet a further example, a cleaning tool is provided and includes a cleaning head having a plurality of panels selectively pivotal relative to each other between a flat position and an upward pivoted position. The panels may be secured in the upward pivoted position. The cleaning head also includes an unlatching mechanism for un-securing the panels from the upward pivoted position to facilitate movement of the panels to the flat position.

In still a further example, a cleaning tool is provided and includes a cleaning head having a main panel, a handle coupled to the main panel via a universal joint, a first side panel pivotally coupled to a first edge of the main panel and pivotal between a flat position and an upward pivoted position, a second side panel pivotally coupled to a second edge of the main panel opposite the first edge and pivotal between a flat position and an upward pivoted position, a first biasing member for biasing the first panel toward its flat position, a second biasing member for biasing the second panel toward its flat position, and at least one ramp member engageable with a surface to cause at least one of the first and second side panels to pivot toward the upward pivoted position. The cleaning head may include a plurality of ramp members. The cleaning head may include four ramp members, two coupled to each of the first and second side panels. The first and second side panels may each be pivoted to a fully upward pivoted position. The cleaning head may include securement members, one securement member for securing each of the first and second side panels in their fully upward pivoted positions. The securement members may be magnets.

In another example, a cleaning tool is provided and includes a cleaning head having a scrubber assembly moveable between a retracted storage position and an extended operating position in order to provide a user with the option to use the cleaning head to wipe a surface or to scrub a surface.

In yet another example, a cleaning tool is provided and includes a cleaning head having a side panel moveable between a flat position and an upward pivoted position. The cleaning head includes an actuator for moving the side panel between the flat and upward pivoted positions. The side panel is also securable in both the flat and upward pivoted positions.

Figure 1:
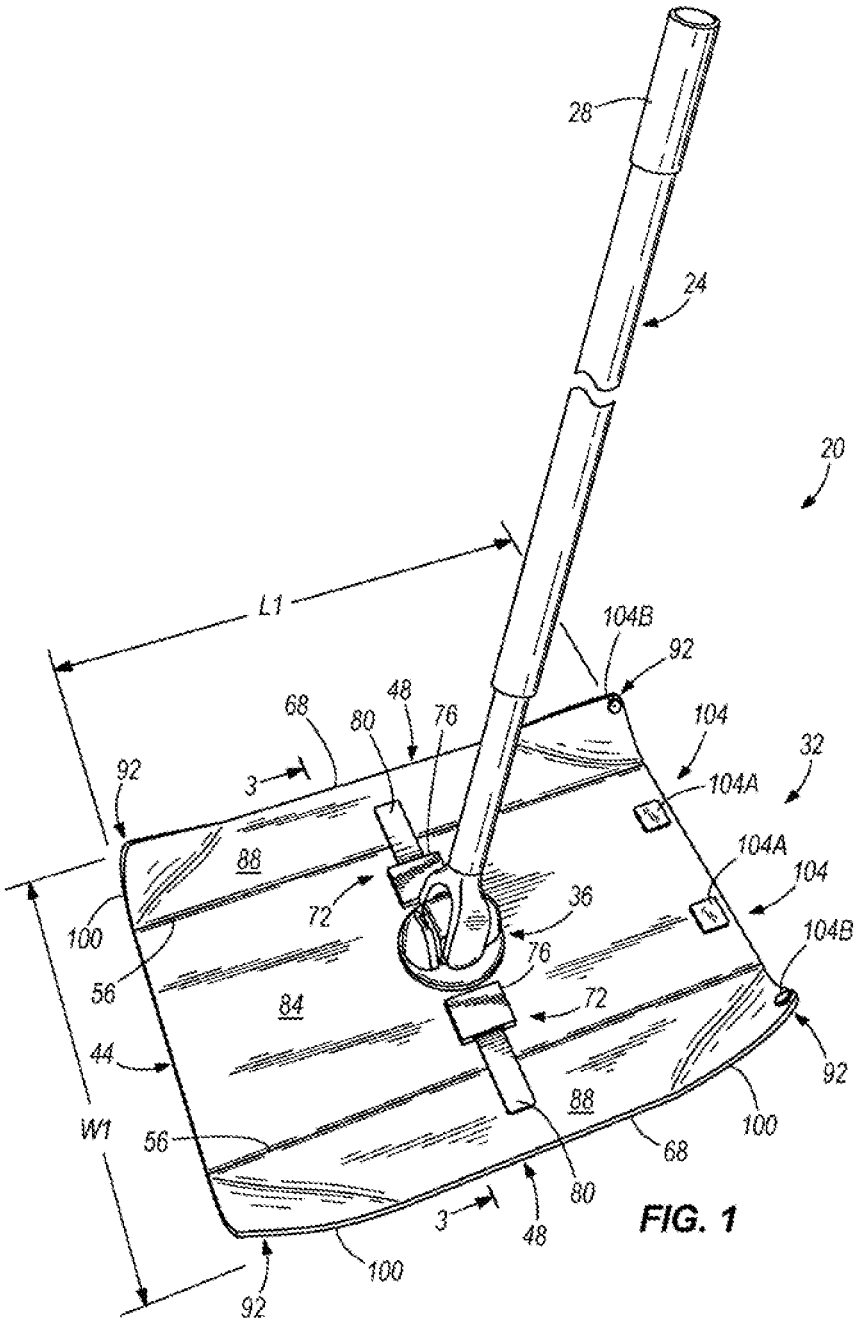
FIG. 1 is a top perspective view of an exemplary cleaning tool.

Before any independent features and embodiments of the invention are explained in detail, it is to be understood that the invention is not limited in its application to the details of the construction and the arrangement of the components set forth in the following description or illustrated in the drawings. The invention is capable of other embodiments and of being practiced or of being carried out in various ways. Also, it is understood that the phraseology and terminology used herein is for the purpose of description and should not be regarded as limiting.

DETAILED DESCRIPTION OF THE INVENTION

With reference to FIG. 1, an exemplary cleaning tool 20 is illustrated. In the illustrated exemplary embodiment, cleaning tool 20 is a hand-operable floor cleaning device including an elongated handle 24, a hand grip 28 coupled to a first end of handle 24, and a cleaning head 32 coupled to a second end of handle 24 via a universal joint 36. In the illustrated exemplary embodiment, universal joint 36 allows the cleaning head 32 to move in a multitude of directions relative to handle 24, thereby providing a user great flexibility in manipulating cleaning tool 20. A wide variety of cleaning implements 40 (see e.g., FIG. 3) may be secured to cleaning head 32 to collect dirt, debris, or other unwanted elements present on a surface to be cleaned. For example, cleaning implements 40 may include a wide variety of cleaning wipes, sheets, or cloths such as, for example, dry disposable sheets, wet and dry microfiber cloths, pre-moistened disposable cleaning sheets, etc.

Exemplary handle 24 is only one of many different types and sizes of handles to which cleaning head 32 may be coupled. For example, cleaning head 32 may be coupled to any other type or size of elongated handle for cleaning a floor surface from a standing position. Also, for example, cleaning head 32 may be coupled to "hand held" type handles commonly characterized as having a shorter handle length than a "stand-up" or "mop" type handle as illustrated in FIG. 1. Further, for example, cleaning head 32 may be coupled to any type or size of handle for cleaning a wide variety of surfaces such as floors, walls, or any other surfaces.

Figure 2:
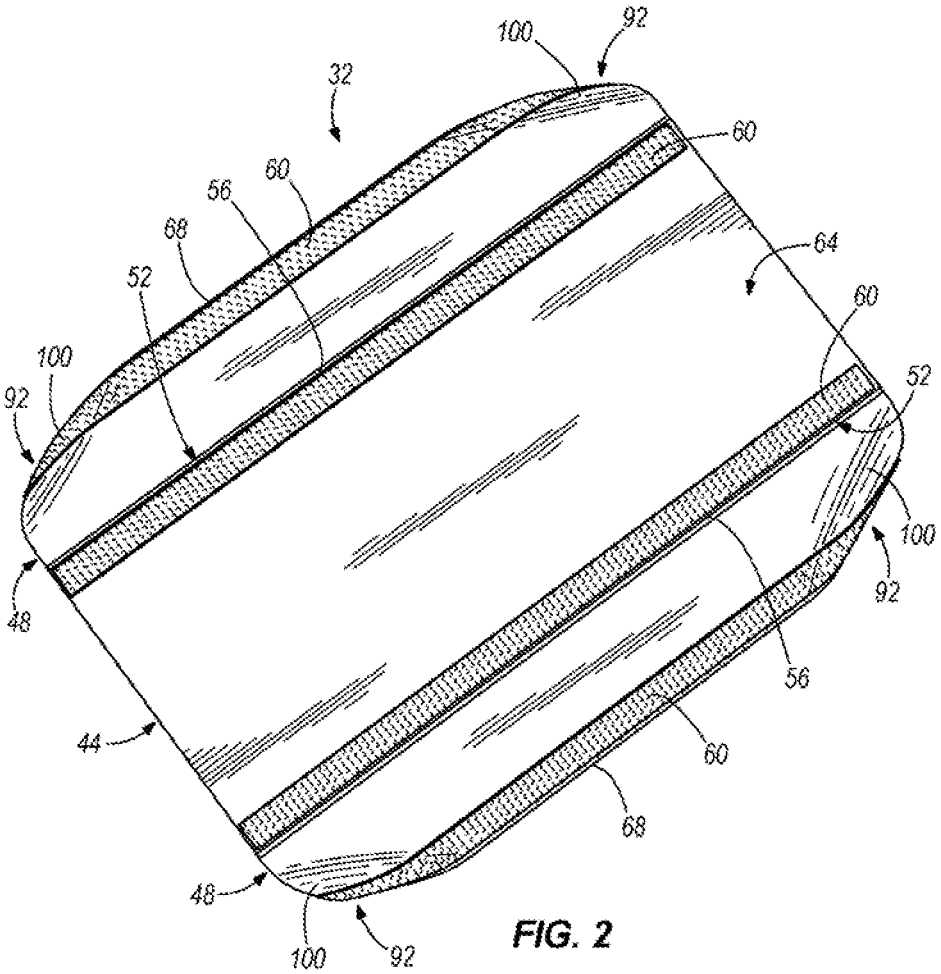
FIG. 2 is a bottom perspective view of the cleaning tool shown in FIG. 1.

With continued reference to FIG. 1 and additional reference to FIG. 2, cleaning head 32 includes a central, main panel 44 and a pair of side panels 48 pivotally coupled to opposing side edges 52 of main panel 44. In the illustrated exemplary embodiment, cleaning head 32 includes two pivotal side panels 48. Alternatively, cleaning head 32 may include other numbers of pivotal side panels 48 and still be within the intended spirit and scope of the present invention. Side panels 48 may be pivotally coupled to main panel 44 in a variety of different manners. In the illustrated exemplary embodiment, side panels 48 are pivotally coupled to main panel 44 via living hinges 56. Alternatively, side panels 48 may be pivotally coupled to main panel 44 via mechanical hinges or other types of pivotable device(s). Living hinges 56 extend parallel to a longitudinal extent of main panel 44. Alternatively, living hinges 56 may extend transversely to the longitudinal extent (i.e., parallel to the latitudinal extent of the cleaning head) or extend some other angle relative to the longitudinal extent of main panel 44.

In the illustrated exemplary embodiment, cleaning head 32 is rectangular in shape. In other exemplary embodiments, cleaning head 32 may be other shapes such as, for example, square, triangular, circular, semi-circular, oval, or any other polygonal or arcuately-perimetered shape. Any of these exemplary alternatively shaped cleaning heads 32 may include a main panel 44 and at least one pivotal side panel 48, with main panel 44 and at least one side panel 48 having an appropriate shape complimentary to the overall shape of cleaning head 32.

With particular reference to FIG. 2, cleaning head 32 includes a plurality of connectors 60 for removably coupling, a cleaning implement 40 to cleaning head 32. In the illustrated exemplary embodiment, connectors 60 are hooks of a hook and loop type fastener. Such hooks are effective at latching onto the materials typically used for making cleaning implements 40. In other exemplary embodiments, connectors 60 may comprise different configurations and may comprise different forms such as, for example, adhesives, a plurality of pie-shaped resilient movable tabs arranged generally in a circular shape for grasping the cleaning cloth, or any other type of connector. Connectors 60 are disposed at various locations on a bottom surface 64 of cleaning head 32. In the illustrated exemplary embodiment, a first connector 60 is disposed near an outer edge 68 of one of the side panels 48, a second connector 60 is disposed near an outer edge 68 of the other side panel 48, a third connector 60 is disposed near a first side edge 52 of main panel 44, and a fourth connector 60 is disposed near a second side edge 52 of main panel 44. The illustrated number and configuration of connectors 60 is for exemplary purposes only and, alternatively, cleaning head 32 may include other numbers of connectors 60 for removably coupling a cleaning implement 40 to cleaning head 32 and be within the intended spirit and scope of the present invention.

Figure 3:
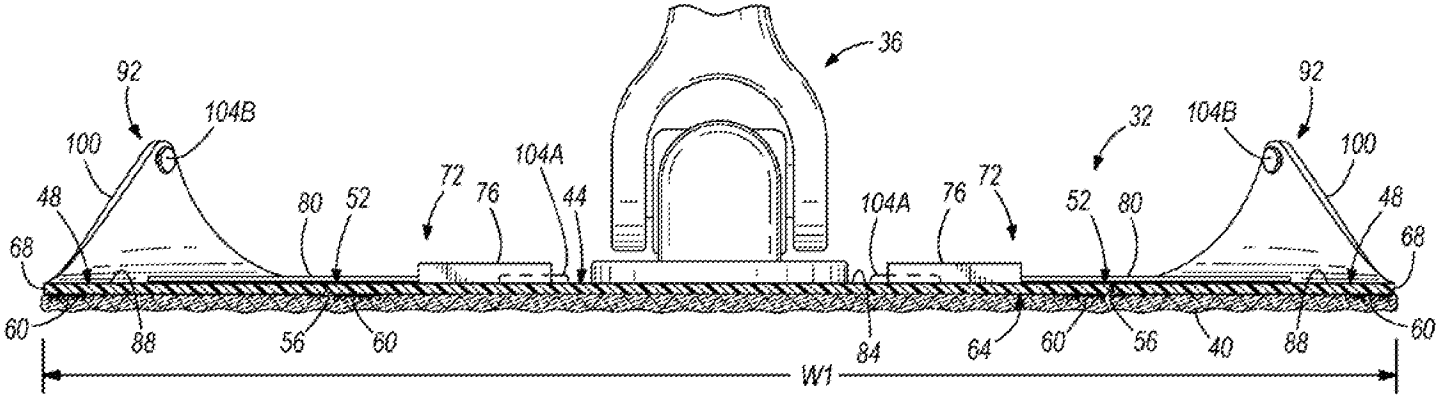
FIG. 3 is a cross-sectional view of the cleaning head of the exemplary cleaning tool taken along line 3-3 in FIG. 1, with the cleaning head shown in a flat position.

Referring now to FIGS. 1-3, cleaning head 32 includes a pair of biasing members 72 for biasing side panels 48 downward to their flat positions, as illustrated in FIGS. 1-3. In the illustrated exemplary embodiment, each biasing member 72 includes a base 76 secured to main panel 44 and an elastic member 80 coupled to base 76. Elastic member 80 extends outward from base 76 to a point beyond living hinge 56 and along top surfaces 84, 88 of main and side panels 44, 48, respectively. When side panels 48 pivot upward out of their flat positions due to an upward force, elastic members 80 apply a downward force on side panels 48. As long as the upward force is greater than the downward force applied by elastic members 80, side panels 48 will remain pivoted upward. When the downward force of elastic members 80 exceeds the upward force applied to side panels 48, elastic members 80 will bias side panels 48 downward toward their flat positions. The illustrated embodiment of biasing members 72 is for exemplary purposes and is not intended to be limiting. Cleaning head 32 may include alternative biasing members 72 to bias side panels 48 toward their flat positions and still be within the intended spirit and scope of the present invention. For example, biasing members 72 may comprise various types of springs, such as coil or leaf springs, engaging a top surface 88 of side panels 48 and applying a downward force. Also, for example, living hinges 56 may be made of an appropriate material that constantly apply a downward force on side panels 48 and, therefore, act as the biasing members themselves. Further, for example, a biasing member may be incorporated with mechanical hinge devices used between main panel 44 and side panels 48 to apply a downward force on side panels 48. Other types of appropriate biasing members are contemplated and are within the intended spirit and scope of the present invention.

Figure 7:
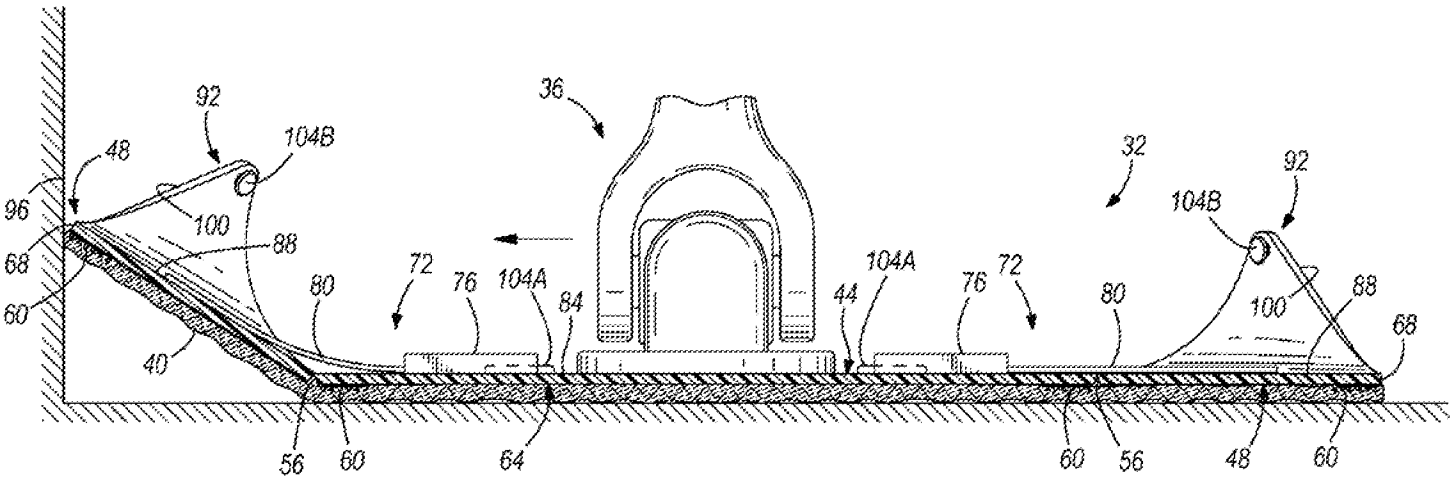
FIG. 7 is a cross-sectional view similar to FIG. 6, with the cleaning head engaging the vertical surface and one of the side panels partially rotated upward.
Figure 8:
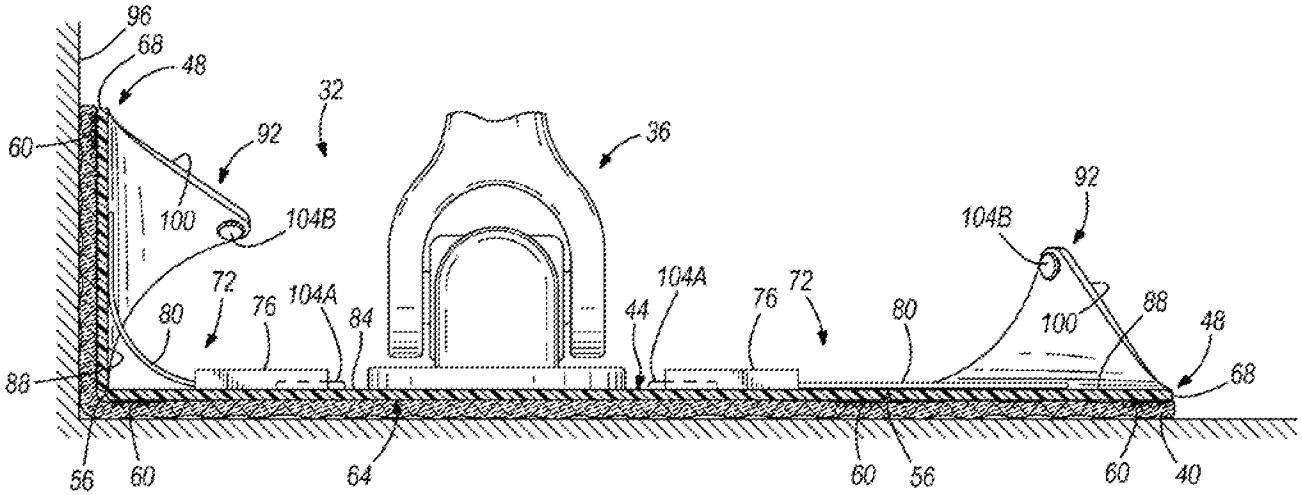
FIG. 8 is a cross-sectional view similar to FIGS. 6 and 7, with the cleaning head engaging the vertical surface and one of the side panels pivoted further upward than in FIG. 7, but less than a fully upward pivoted position as shown in FIGS. 4 and 5.

With continued reference to FIGS. 1-3, cleaning head 32 includes ramp members 92 that can contact a vertical or non-horizontal surface 96 (see FIG. 6) to facilitate upward pivoting of side panels 48 relative to main panel 44. While ramp members 92 are capable of contacting many different types and orientations of surfaces to pivot side panels 48 upward, the following exemplary description and illustrations relate to a vertical surface and such description and illustrations are exemplary and are not intended to be limiting. In the illustrated exemplary embodiment, cleaning head 32 includes four ramp members 92 located at the outer corners of side panels 48. Ramp members 92 may either be unitarily formed with side panels 48 (as illustrated) or may be separately formed elements coupled to side panels 48. Each ramp member 92 provides a ramp surface 100 that can contact a vertical surface 96 and facilitates sliding movement of ramp surface 100 up and along vertical surface 96, thereby causing side panel 48 to pivot upward relative to main panel 44, as shown in FIGS. 7 and 8. It should be understood that the illustrated ramp members 92 are only one exemplary construction of possible ramp members 92 and that other constructions of ramp members 92 are contemplated and are within the intended spirit and scope of the present invention.

Referring back to FIG. 1, cleaning head 32 includes a pair of securement members 104 for securing side panels 48 to main panel 44 in fully upward pivoted positions. In the illustrated exemplary embodiment, securement members 104 comprise magnets 104A coupled to top surface 84 of main panel 44 and metallic members 104B, or appropriately polarized magnets, coupled to tips of ramp members 92. Magnets 104A and metallic members 104B are engageable with each other to selectively couple side panels 48 to main panel 44. As desired, a user may manually pivot one or both side panels 48 upward relative to main panel 44 until metallic member 104B on ramp member 92 engages magnet 104A coupled to top surface 84 of main panel 44, thereby securing side panels 48 to main panel 44 in their fully upward pivoted positions. The illustrated exemplary securement members 104 are not intended to be limiting. For example, in other exemplary embodiments, securement members 104 may be comprised of other devices for securing side panels 48 to main panel 44 in their fully upward pivoted positions.

Now that the structure of cleaning tool 20 has been described, operation of cleaning tool 20 will be described herein.

With reference to FIG. 3, cleaning head 32 is illustrated in its flat position. In the flat position, cleaning head 32 has a first cleaning area defined by a width W1 between outer edges 68 of side panels 48 (see FIGS. 1 and 3) and a length L1 along the longitudinal extent of cleaning head 32 (see FIG. 1). In the illustrated exemplary embodiment, this first configuration of cleaning head 32 provides the largest possible cleaning area.

Figure 4:
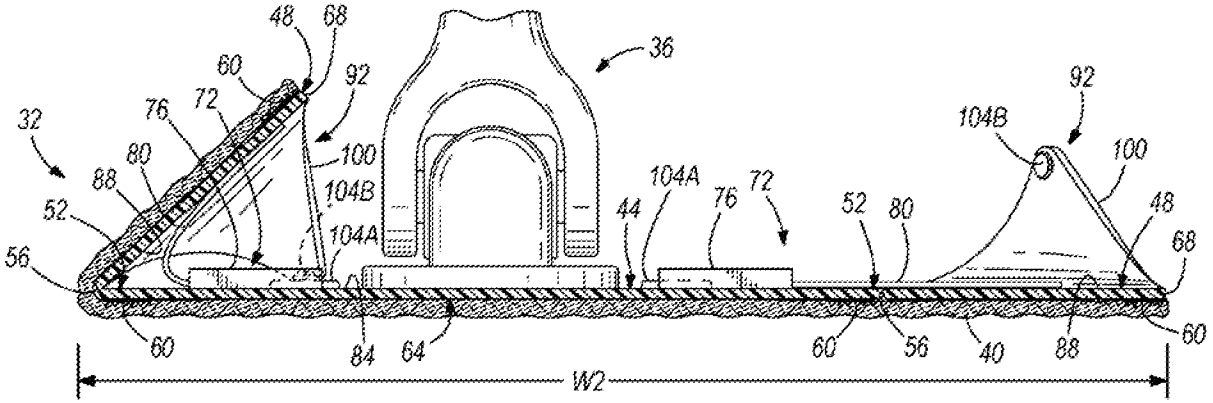
FIG. 4 is a cross-sectional view of the cleaning head similar to FIG. 3, with one side panel of the cleaning head shown in a fully upward pivoted position and secured in position by a securement member.

With reference to FIG. 4, cleaning head 32 is illustrated with one side panel 48 positioned in its fully upward pivoted position and secured in place by the associated securement member 104. In this position, cleaning head 32 has a second cleaning area defined by a width W2 between outer edge 68 of side panel 48 in its flat position and side edge 52 of main panel 44 adjacent side panel 48 positioned in its fully upward pivoted position, and the length L1 along the longitudinal extent of cleaning head 32. In this illustrated exemplary embodiment, this second configuration of cleaning head 32 provides a second sized cleaning area smaller than the cleaning area associated with the first configuration.

Figure 5:
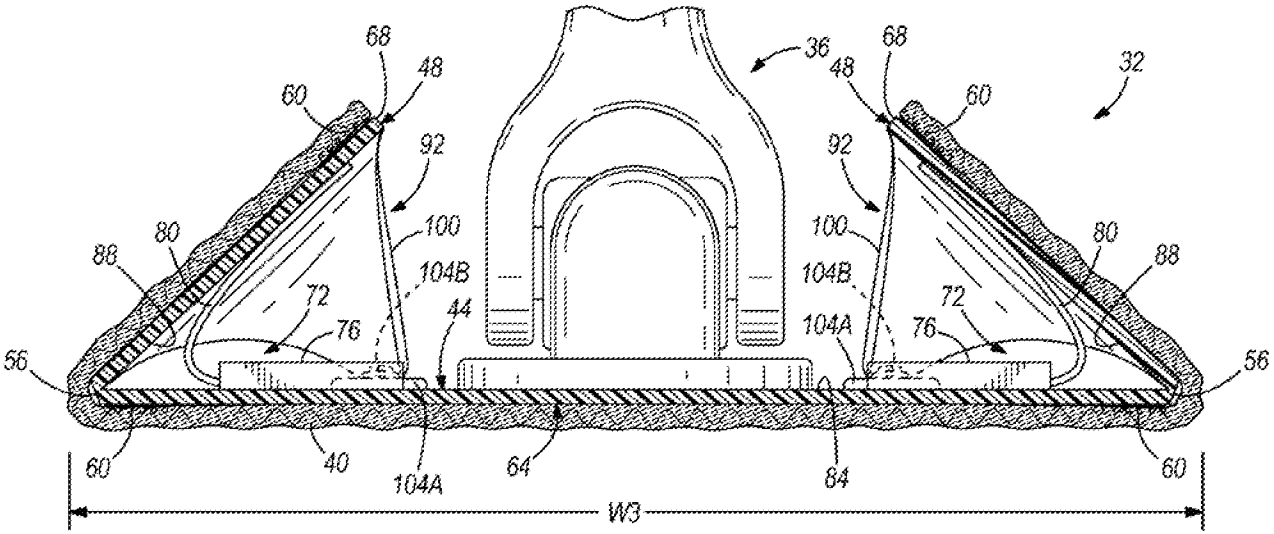
FIG. 5 is a cross-sectional view of the cleaning head similar to FIGS. 3 and 4, with both side panels of the cleaning head shown in a fully upward pivoted position and secured in position by securement members.

Referring now to FIG. 5, cleaning head 32 is illustrated with both side panels 48 positioned in their fully upward pivoted positions and secured in place by securement members 104. In this position, cleaning head 32 has a third cleaning area defined by a width W3 between side edges 52 of main panel 44 and the length L1 along the longitudinal extent of cleaning head 32. In this illustrated exemplary embodiment, this third configuration of cleaning head 32 provides the smallest possible cleaning area.

The various cleaning head configurations and associated cleaning areas provide a user with the ability to choose the cleaning area that best accommodates the environment and conditions in which cleaning tool 20 will be used. For example, in environments having a wide open floor surface without many obstacles, a user may desire to use cleaning head 32 in its first configuration and largest cleaning area, which would allow a user to cover the wide open environment in an efficient manner. Also, for example, in environments having many obstacles and narrow distances between obstacles, a user may desire to use cleaning head 32 in its third configuration and smallest cleaning area, which would allow a user to more easily manipulate cleaning head 32 around and between the obstacles on the floor surface.

As indicated previously, side panels 48 have the capability of pivoting upward upon engagement with a vertical or other non-horizontal surface 96. This feature allows a user to utilize cleaning head 32 in its first configuration to efficiently clean a horizontal floor surface, and also allows cleaning head 32 to clean portions of vertical surface 96 and access difficult to clean areas such as corners between the floor surface and vertical surface 96.

Figure 6:
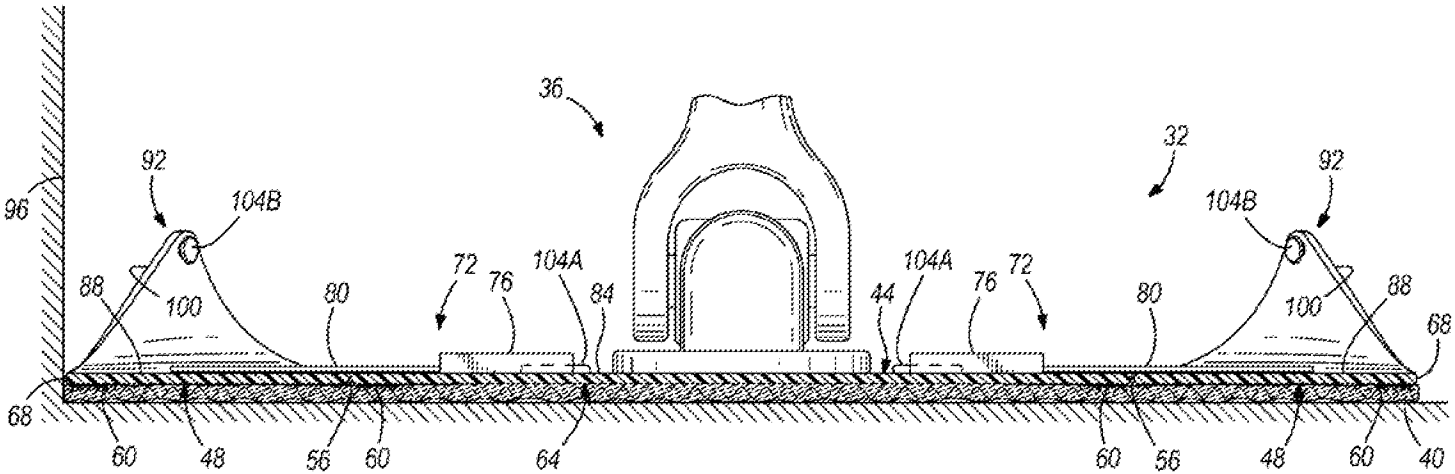
FIG. 6 is the cross-sectional view of FIG. 3, with the cleaning head in contact with a floor surface and a vertical surface.

With reference to FIG. 6, cleaning head 32 is illustrated just prior to contact with vertical surface 96. Prior to contact with vertical surface 96, cleaning head 32 is positioned in its first configuration or fully flat position. Referring now to FIG. 7, cleaning head 32 is pushed into vertical surface 96 such that one of the ramp members 92 contacts vertical surface 96 and rides upward along vertical surface 96. This upward movement along vertical surface 96 causes side panel 48 to pivot upward. During this upward pivoting movement of side panel 48, the associated biasing member 72 is being deflected or compressed to exert a downward force on side panel 48. With reference to FIG. 8, cleaning head 32 is pushed fully against vertical surface 96 until main panel 44 abuts or nearly abuts vertical surface 96. In this position, ramp surface 100 of ramp member 92 rides further upward along vertical surface 96 until bottom surface 64 of side panel 48 is parallel with vertical surface 96 and side edge 52 of main panel 44 engages or nearly engages vertical surface 96. Also, in this position, biasing member 72 is further deflected or compressed to continue exertion of a downward force on side panel 48. As illustrated in FIG. 8, the side panel 48 abutting vertical surface 96 is located at a position between its flat position and its fully upward pivoted position. Since side panel 48 is not secured in its fully upward pivoted position when used in this manner, side panel 48 is capable of being biased downward toward its flat position under the bias of biasing member 72 when cleaning head 32 is moved away from vertical surface 96. A user may move cleaning head 32 into and out of contact with vertical surface 96 as desired to utilize this feature of cleaning head 32.

Figure 9:
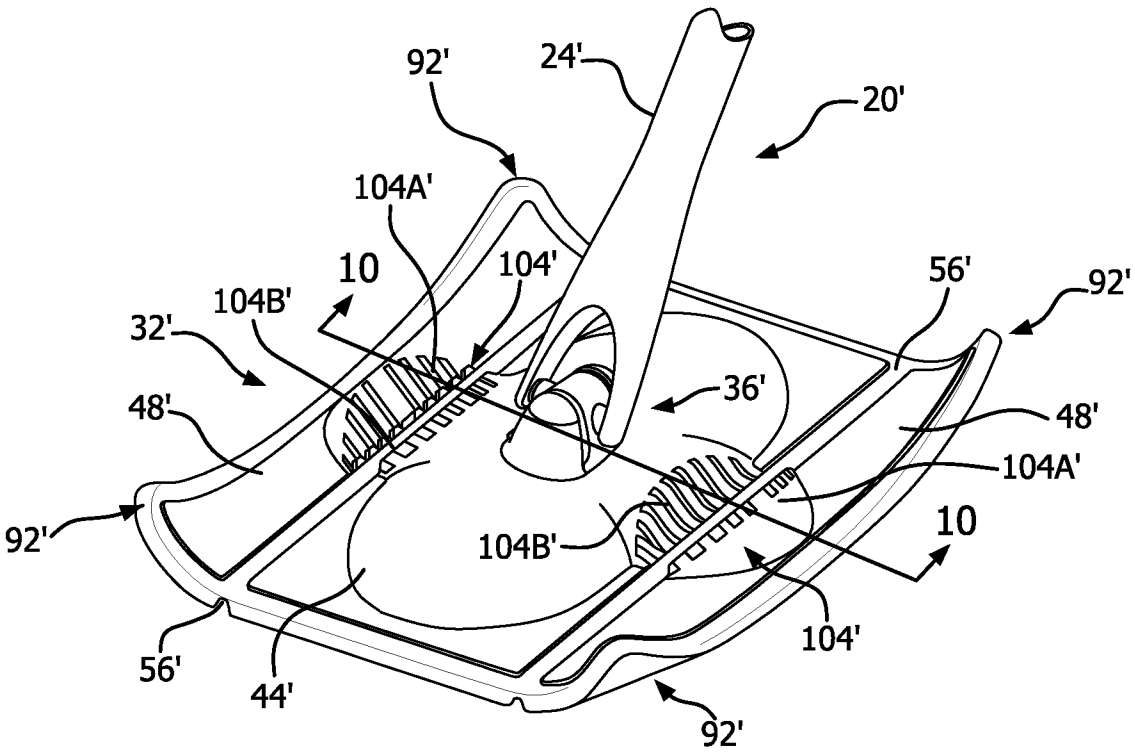
FIG. 9 is a partial top perspective view of another exemplary cleaning tool.
Figure 10:
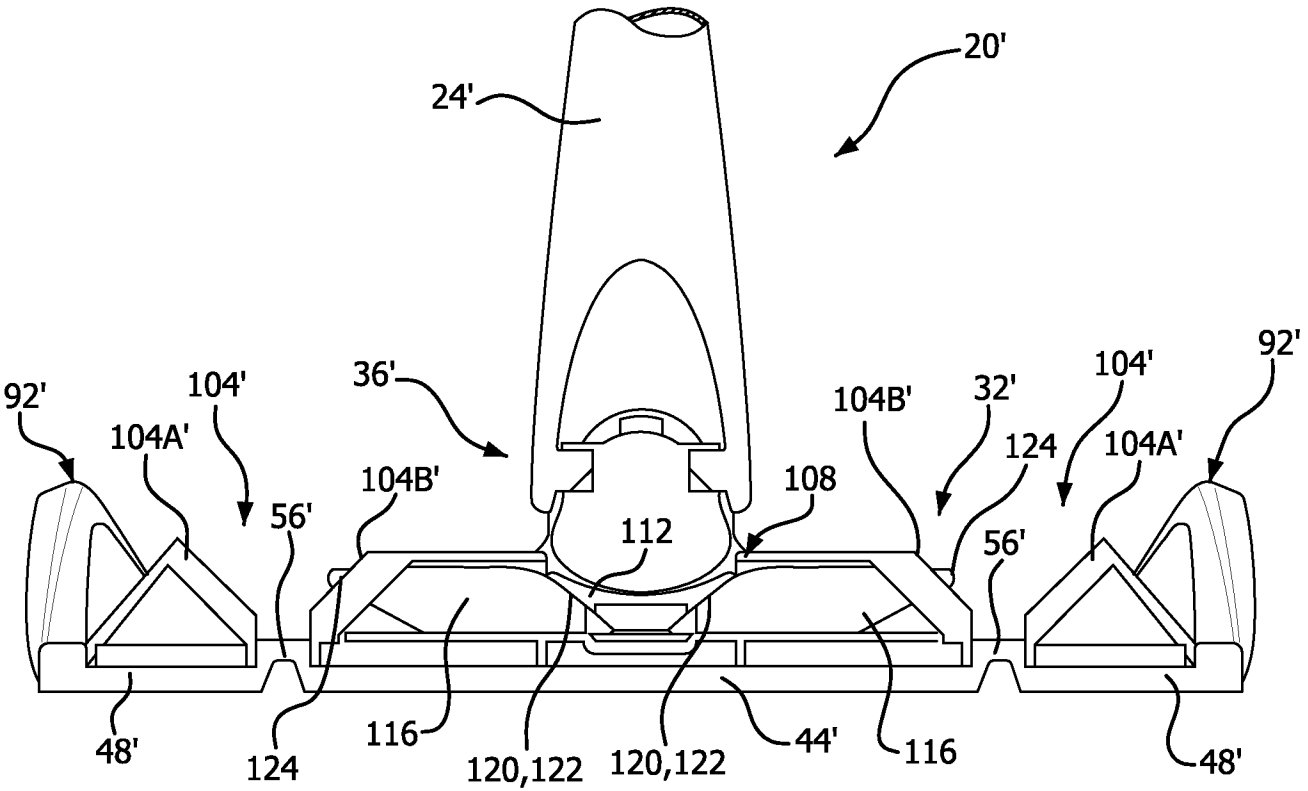
FIG. 10 is a cross-sectional view of the cleaning tool taken along line 10-10 in FIG. 9.
Figure 11:
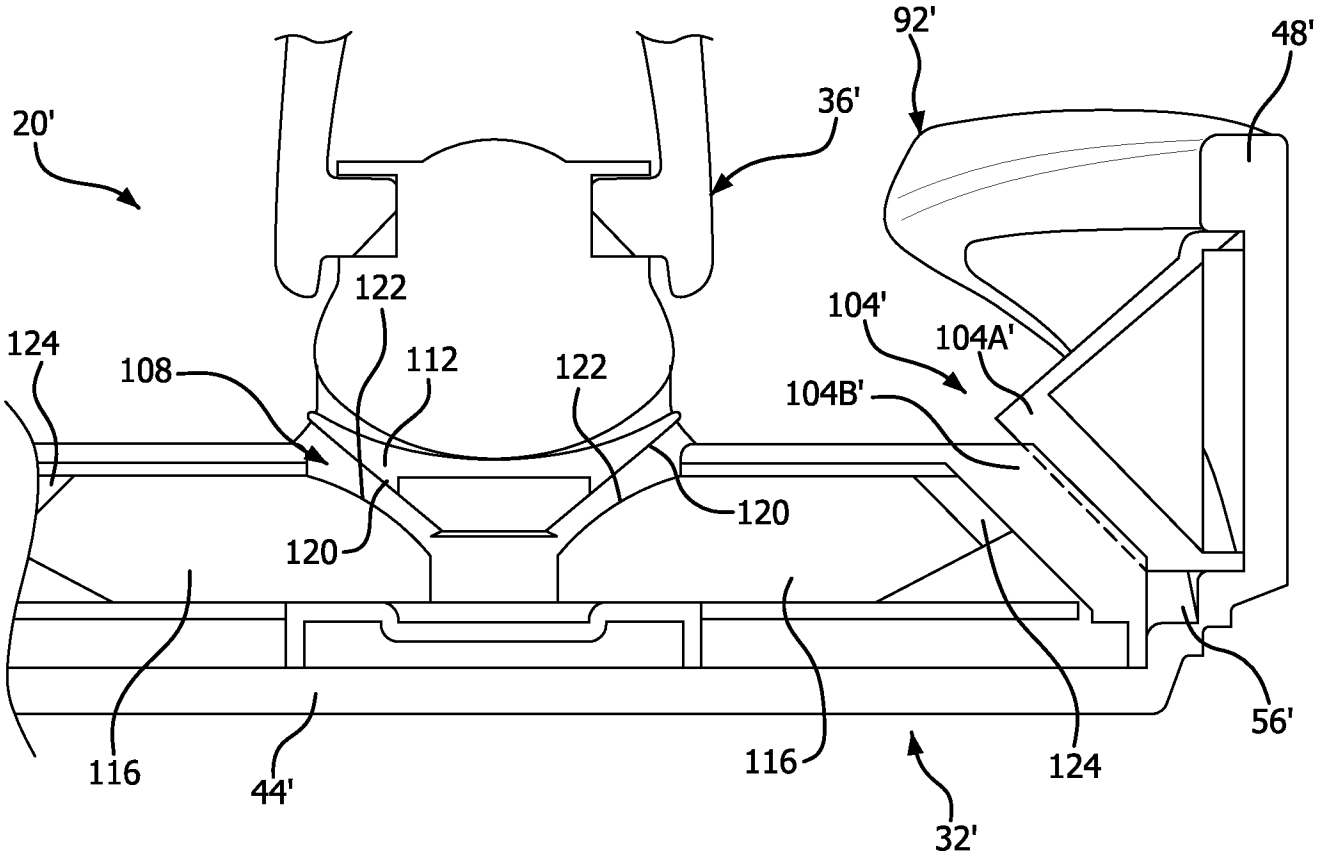
FIG. 11 is an enlarged cross-sectional view of the cleaning tool similar to FIG. 10, with one panel of the cleaning head in a fully upward pivoted position.

Referring now to FIGS. 9-11, another exemplary cleaning tool 20' is illustrated. Components of cleaning tool 20' illustrated in FIGS. 9-11 similar to components of cleaning tool 20 illustrated in FIGS. 1-8 are identified with the same reference number and an "'". The differences between the cleaning tool 20' illustrated in FIGS. 9-11 and the cleaning tool 20 illustrated in FIGS. 1-8 will be described herein in detail.

With particular reference to FIG. 9, cleaning tool 20' includes a pair of securement members 104' for coupling side panels 48' to main panel 44' in their fully upward pivoted positions. In the illustrated exemplary embodiment, each securement member 104 comprises a first set of spaced projections 104A' positioned on a respective side panel 48' and a second set of spaced projections 104B' positioned on a corresponding side of main panel 44'. The first and second sets of spaced projections 104A', 104B' are offset from one another such that the projections of the first set of spaced projections 104A' inserts into spaces between the projections of the second set of spaced projections 104B' and the projections of the second set of spaced projections 104B' insert into spaces between the projections of the first set of spaced projections 104A'. That is, the projections of the first and second sets of projections interlace with each other. The projections and spaces of securement members 104' are appropriately sized to provide an interference, friction, or press-fit when the projections are positioned in the spaces. The described and illustrated exemplary securement members 104' are not intended to be limiting. Other securement members are possible and contemplated, and are within the intended spirit and scope of the present invention.

As desired, a user may manually pivot one or both side panels 48' upward relative to main panel 44' until securement members 104' couple side panels 48' to main panel 44' to secure side panels 48' in their fully upward pivoted positions. In addition, an operator may pivot one or both side panels 48' upward by engaging one or more ramp member 92' with a non-horizontal surface, as described above. Upon engagement with a non-horizontal surface, ramp members 92' pivot side panels 48' upward until securement members 104' couple side panels 48' to main panel 44' in their fully upward pivoted positions.

Referring now to FIGS. 10 and 11, cleaning tool 20' includes an uncoupling mechanism 108 for uncoupling side panels 48' from main panel 44' to facilitate movement of side panels 48' to their flat positions. FIG. 10 illustrates uncoupling mechanism 108 in its actuated position and FIG. 11 illustrates a portion of uncoupling mechanism 108 in its unactuated position. Uncoupling mechanism 108 includes a first member 112 and a pair of uncoupling fingers 116. First member 112 is positioned adjacent and underneath universal joint 36' and includes a pair of ramped surfaces 120. Each uncoupling finger 116 includes an engagement portion 124 and a ramp surface 122 complementary to and aligned with ramped surfaces 120 of first member 112.

To uncouple side panels 48' from main panel 44' while in their fully upward pivoted positions, a user depresses handle 24' downward moving a portion of universal joint 36' into contact with a top surface of first member 112. First member 112 moves downward bringing ramped surfaces 120 of first member 112 into contact with the corresponding ramp surfaces 122 of uncoupling fingers 116. Continued downward depression of handle 24' slides uncoupling fingers 116 outward away from the longitudinal center of cleaning head 321, thereby bringing uncoupling fingers 116 into contact with side panels 48' and pushing side panels 48' away from main panel 44'. In the illustrated exemplary embodiment, the engagement portion 124 of each uncoupling finger 116 is aligned with a respective one of the spaces provided in the second set of spaced projections 104B' to facilitate passage of engagement portion 124 through the space, out of main panel 44', and into engagement with the respective side panel 48'. After sufficient movement of side panels 48' away from main panel 44', securement members 104' uncouple and side panels 48' move toward their flat positions. After side panels 48' are uncoupled from main panel 44', a user may cease depressing handle 24' downward. Uncoupling mechanism 108 may include one or more biasing members biasing first member 112 upward and uncoupling fingers 116 inward such that first member 112 and uncoupling fingers 116 return to their unactuated positions (see FIG. 11) upon termination of a downward depression on handle 241. In order to move uncoupling mechanism 108 from its un-actuated position to its actuated position, a user must supply sufficient downward force on handle 24' to overcome the force of the biasing member(s).

Upon uncoupling side panels 48' from main panel 44', side panels 48' may be moved from their fully upward pivoted position to their flat positions in several manners. In some exemplary embodiments, living hinge 56' is made of an appropriate material that provides biasing and returns side panels 48' to their flat positions upon uncoupling of side panels 48' from main panel 44'. For example, living hinges 56' may be made of elastic or substantially elastic material providing living hinges 56' with stored energy when side panels 48' are in their fully upward pivoted positions and such stored energy moves side panels 48' to their flat positions when side panels 48' are uncoupled from main panel 44. In other exemplary embodiments, cleaning head 32' may include biasing members similar to those illustrated and described in connection with FIGS. 1-8 to bias side panels 48' to their flat positions. It should be understood that the manners described and illustrated herein for moving side panels 48' from their fully upward pivoted positions to their flat positions are not limiting and that other manners are possible and contemplated, and are within the intended spirit and scope of the present invention.

Referring now to FIGS. 12-29, a further exemplary cleaning tool 20" is illustrated. Components of cleaning tool 20" illustrated in FIGS. 12-29 similar to components of cleaning tools 20, 20' respectively illustrated in FIGS. 1-11 are identified with the same reference number and an "'".

Figure 12:
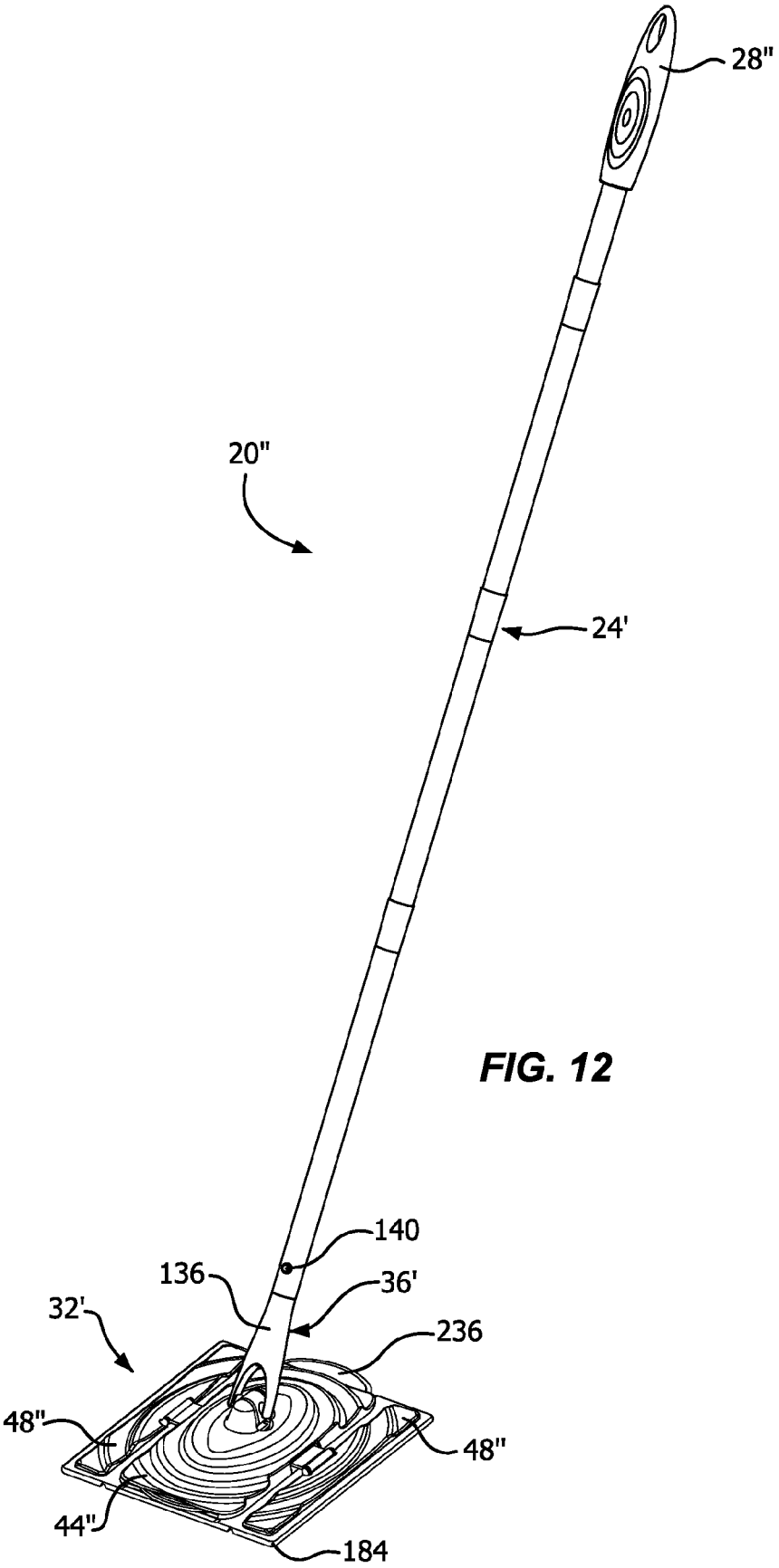
FIG. 12 is a top front perspective view of a further exemplary cleaning tool with the cleaning tool shown in a flat position.
Figure 13:
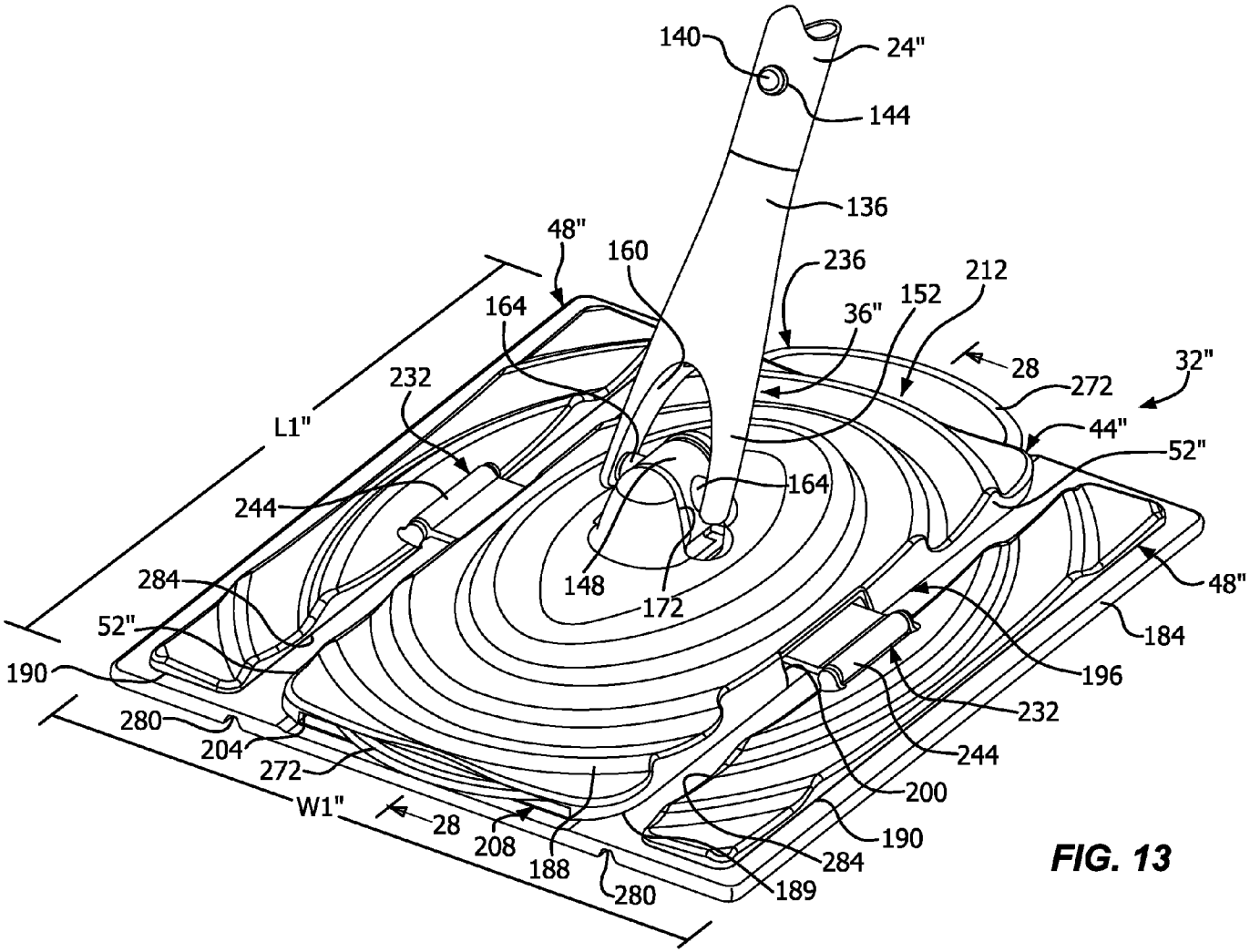
FIG. 13 is an enlarged top front perspective view of the cleaning tool shown in FIG. 12.
Figure 14:
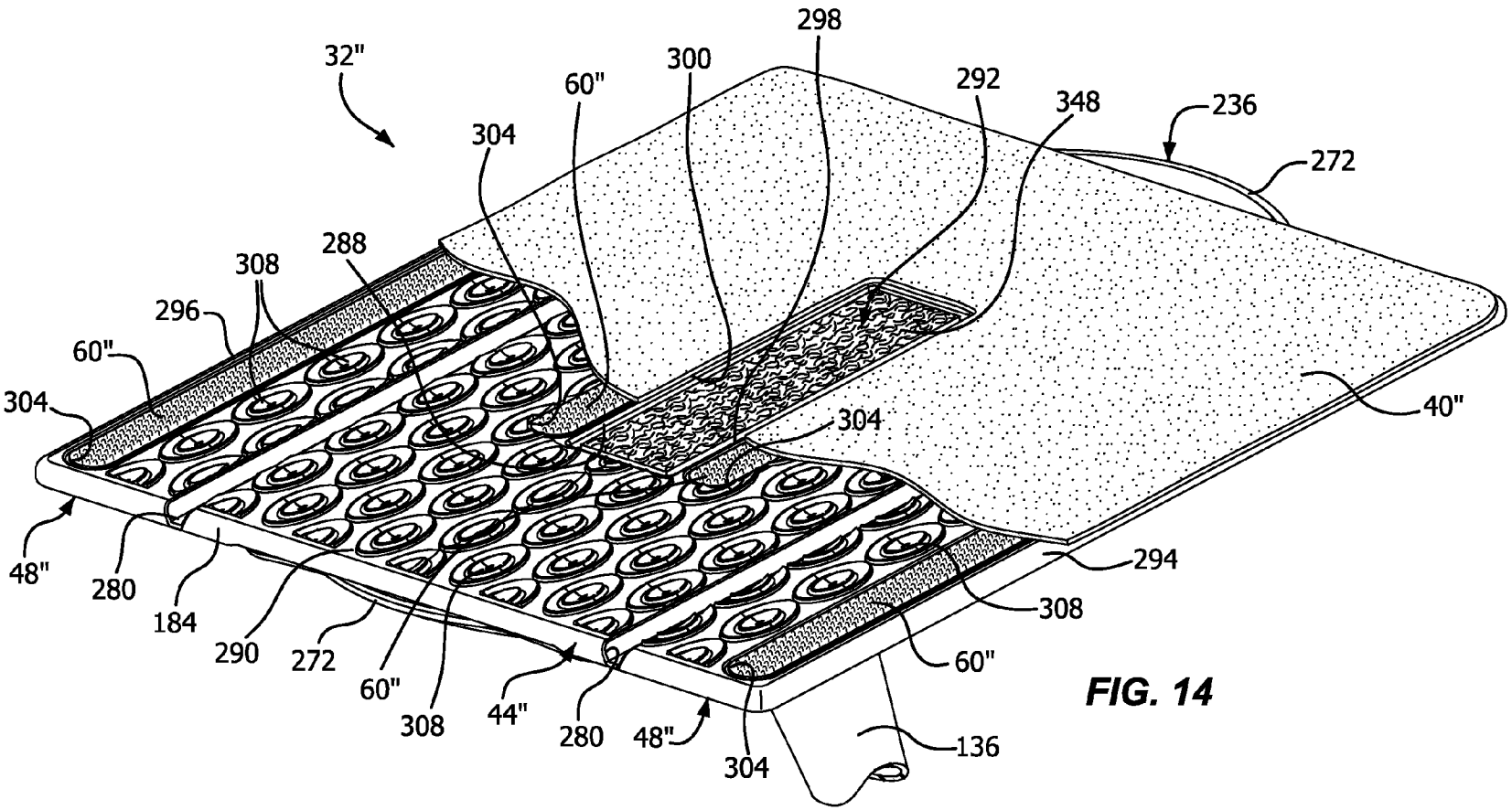
FIG. 14 is a bottom front perspective view of the cleaning tool shown in FIG. 12.

With particular reference to FIGS. 12-14, the illustrated exemplary embodiment of cleaning tool 20" is a hand-operable floor cleaning device including an elongated handle 24", a hand grip 28" coupled to a first end of handle 24", and a cleaning head 32" coupled to a second end of handle 24" via a universal joint 36".

Exemplary handle 24" is only one of many different types and sizes of handles to which cleaning head 32" may be coupled. In the illustrated exemplary embodiment, handle 24" is a multi-segment handle having four segments connectable together to provide handle 24" with its full length, but could also be a unitary one piece handle. Three of the four segments are coupled together via a press-fit or interference fit and a bottom segment of handle 24" is coupled to universal joint 36" with a detent type connection, in which universal joint 36" comprises a connection member 136 including a detent 140, and bottom segment of handle 24" includes an opening 144 alignable with detent 140 such that detent 140 is selectively positionable in opening 144 to removably connect handle 24" to universal joint 36" and cleaning head 32". In other exemplary embodiments, cleaning head 32" may be coupled to any other type or size of elongated handle for cleaning a floor surface from a standing position and can be coupled using any well known method. In yet other exemplary embodiments, cleaning head 32" may be coupled to "hand held" type handles commonly characterized as having a shorter handle length than a "stand-up" or "mop" type handle 24". In further exemplary embodiments, cleaning head 32" maybe coupled to any type or size of handle for cleaning a wide variety of surfaces such as floors, walls, or any other surfaces.

In the illustrated exemplary embodiment, universal joint 36" allows cleaning head 32" to move in a multitude of directions relative to handle 24", thereby providing a user great flexibility in manipulating cleaning tool 20". With continued reference to FIGS. 12-14 and additional reference to FIGS. 15-17, universal joint 36" includes connection member 136 (as indicated above) and a swivel 148. Along with detent 140 positioned at a top end of connection member 136, connection member 136 also includes a yolk 152 oriented at a bottom end of connection member 136 and a pair of projections 156 extending inwardly toward each other and into a cavity 160 defined by yolk 152. In the illustrated exemplary embodiment, projections 156 are substantially aligned along a common longitudinal axis extending laterally through their centers. Swivel 148 includes a pair of receptacles 164 and a pair of swivel projections 168. Receptacles 164 are defined on a first pair of opposing sides of swivel 148, while projections 168 extend from a second pair of opposing sides of swivel 148. Receptacles 164 are adapted to receive projections 156 extending from connection member 136 and are therefore complementarily shaped to projections 156 and appropriately aligned to receive projections 156 therein. Swivel 148 itself is positioned in a swivel receptacle 172 defined in a top of main panel 44". Swivel projections 168 are substantially aligned along a common longitudinal axis extending laterally through their centers and are adapted to extend through slots 176 in top portion 188 of main panel 44" and into apertures 328 defined in a portion of scrubber assembly 180 (described in greater detail below). This configuration of universal joint 36" facilitates rotation about two axes, one of which is along the axis extending horizontally through connection member projections 156 and the other is along the axis extending transverse to the first axis and horizontally through swivel projections 168. These two axes of rotation facilitate great flexibility in movement of handle 24" relative to cleaning head 32".

Referring now to FIGS. 2-25, cleaning head 32" includes a central, main panel 44", a pair of side panels 48" pivotally coupled to opposing side edges 52" of main panel 44", a pad 184 coupled to bottom surfaces 189, 190 of both main panel 44" and side panels 48", and a scrubber assembly 180.

Main panel 44" includes a top portion 188, a base 192, and a pivoting assembly 196. Top portion 188 includes a stepped contour and defines a pair of plate openings 200 in opposing side edges 52" and a pair of actuator openings 204 defined in opposing front edge 208 and rear edge 212. Base 192 includes a stepped support structure 216 complementarily shaped to the stepped contour of top portion 188 to engage and provide support to top portion 188 from below. Base 192 also includes a pair of plate supports 220 aligned with plate openings 200 in top portion 188, a pair of spaced apart actuator channels 224, and a scrubber receptacle 228. Pivoting assembly 196 includes an actuator 236 and at least one side panel operating member 232 connected to actuator 236. In the exemplary embodiment, the side panel operating member(s) 232 is constructed as a pair of slide plates. Slide plates 232 are respectively positioned in plate supports 220 defined in base 192 and extend outwardly through plate openings 200 defined in main panel 44". Each slide plate 232 includes a slot 240 and a coupling member 244 for coupling to respective side panels 48". Each slot 240 has a longitudinal shape and is angled to inner edge 248 and coupling member 244 of slide plate 232. Slots 240 have a capture portion 252 at each end thereof defined by indents 256, which provide a reduced slot width immediately preceding capture portions 252. Actuator 236 includes a cavity 260, side portions 264, and a pair of projections 268 extending upward from a top surface of side portions 264. Side portions 264 of actuator 236 are positioned in actuator channels 224 and stepped support structure 216 of base 192 is positioned in actuator cavity 260. An engagement member 272 may be disposed at opposing ends of actuator 236 for engagement by a user or an object to actuate actuator 236 (described in greater detail below). Each actuator projection 268 is received in and moveable within a respective one of plate slots 240.

With continued reference to FIGS. 12-25, the illustrated exemplary embodiment of cleaning head 32" includes two pivotal side panels 48". Alternatively, cleaning head 32" may include other numbers of pivotal side panels 48" and still be within the intended spirit and scope of the present invention. Side panels 48" have a stepped contour complementary to the stepped contour of main panel 44". Side panels 48" may be pivotally coupled to main panel 44" in a variety of different manners. In the illustrated exemplary embodiment, each side panel 48" includes a hinge post 276 coupled to coupling member 244 of a respective slide plate 232. Hinge posts 276 extend parallel to longitudinal extents of main panel 44" and side panels 48". Alternatively, hinge posts 276 may extend transversely to the longitudinal extent (i.e., parallel to the latitudinal extent of cleaning head 32") or extend some other angle relative to the longitudinal extent of main panel 44".

Pad 184 is coupled to bottom surfaces 189, 190 of main panel 44" and side panels 48" through any well known means, such as an adhesive or mechanical connection. Pad 184 may be made of an elastic, flexible material that is hydrophobic or non-absorbent to prevent absorption of liquids. For example, pad 184 may be made of a closed cell foam, etc. In the illustrated exemplary embodiment, pad 184 includes a pair of recesses 280, in the embodiment shown living hinges, defined in a bottom surface 290 of pad 184 and substantially aligned with spaces between edges 52" of main panel 44" and inner edges 284 of side panels 48". Pad 184 includes such recesses 280 to reduce the pad's resistance to pivoting of side panels 48" relative to main panel 44". Pad 184 also defines an opening 288 through which a scrubber 292 may selectively protrude.

In the illustrated exemplary embodiment, cleaning head 32" is rectangular in shape. In other exemplary embodiments, cleaning head 32" may be other shapes such as, for example, square, triangular, circular, semi-circular, oval, or any other polygonal or arcuately-perimetered shape. Any of these exemplary alternatively shaped cleaning heads 32" may include a main panel 44" and at least one pivotal side panel 48", with main panel 44" and at least one side panel 48" having an appropriate shape complimentary to the overall shape of cleaning head 32".

Figure 15:
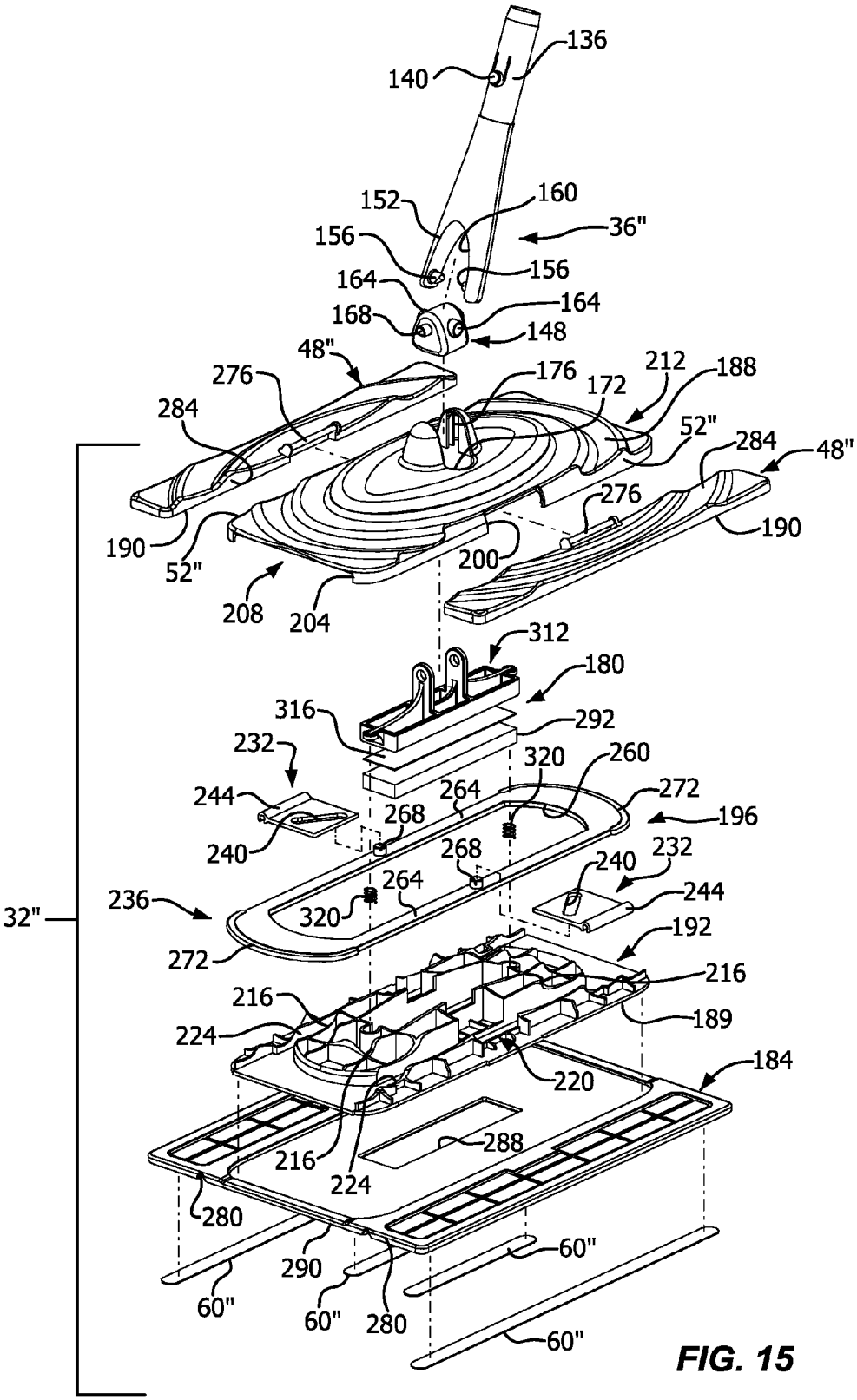
FIG. 15 is an exploded view of the cleaning tool shown in FIG. 12.
Figure 16:
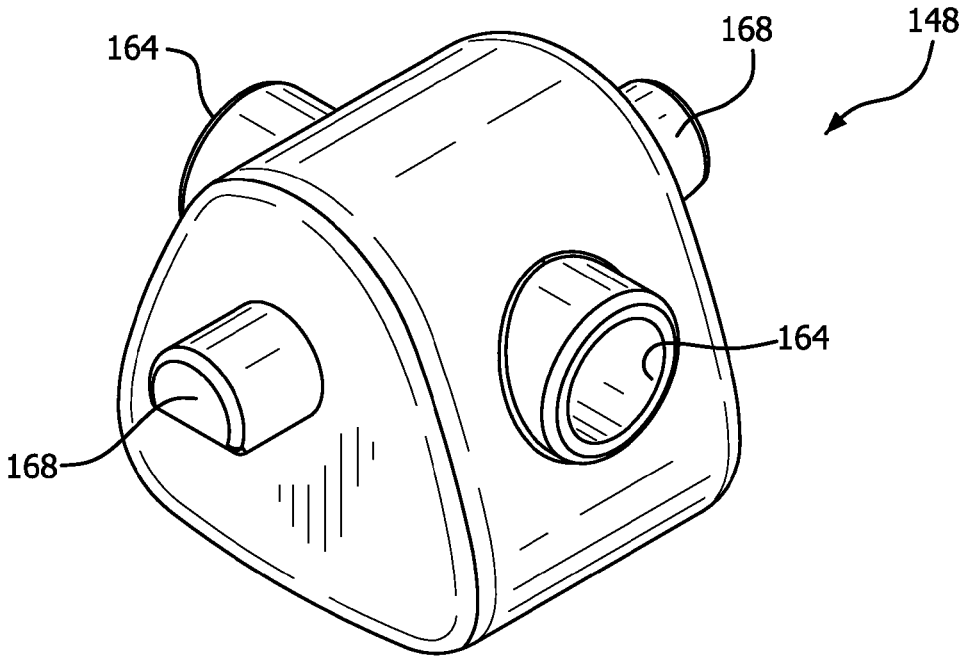
FIG. 16 is a top perspective view of a swivel of the cleaning tool shown in FIG. 12.
Figure 17:
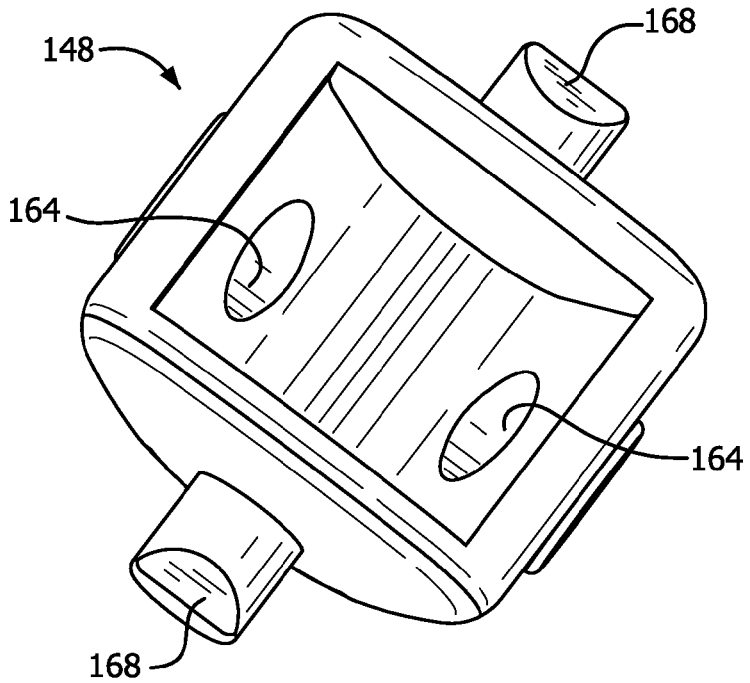
FIG. 17 is a bottom perspective view of the swivel shown in FIG. 16.
Figure 18:
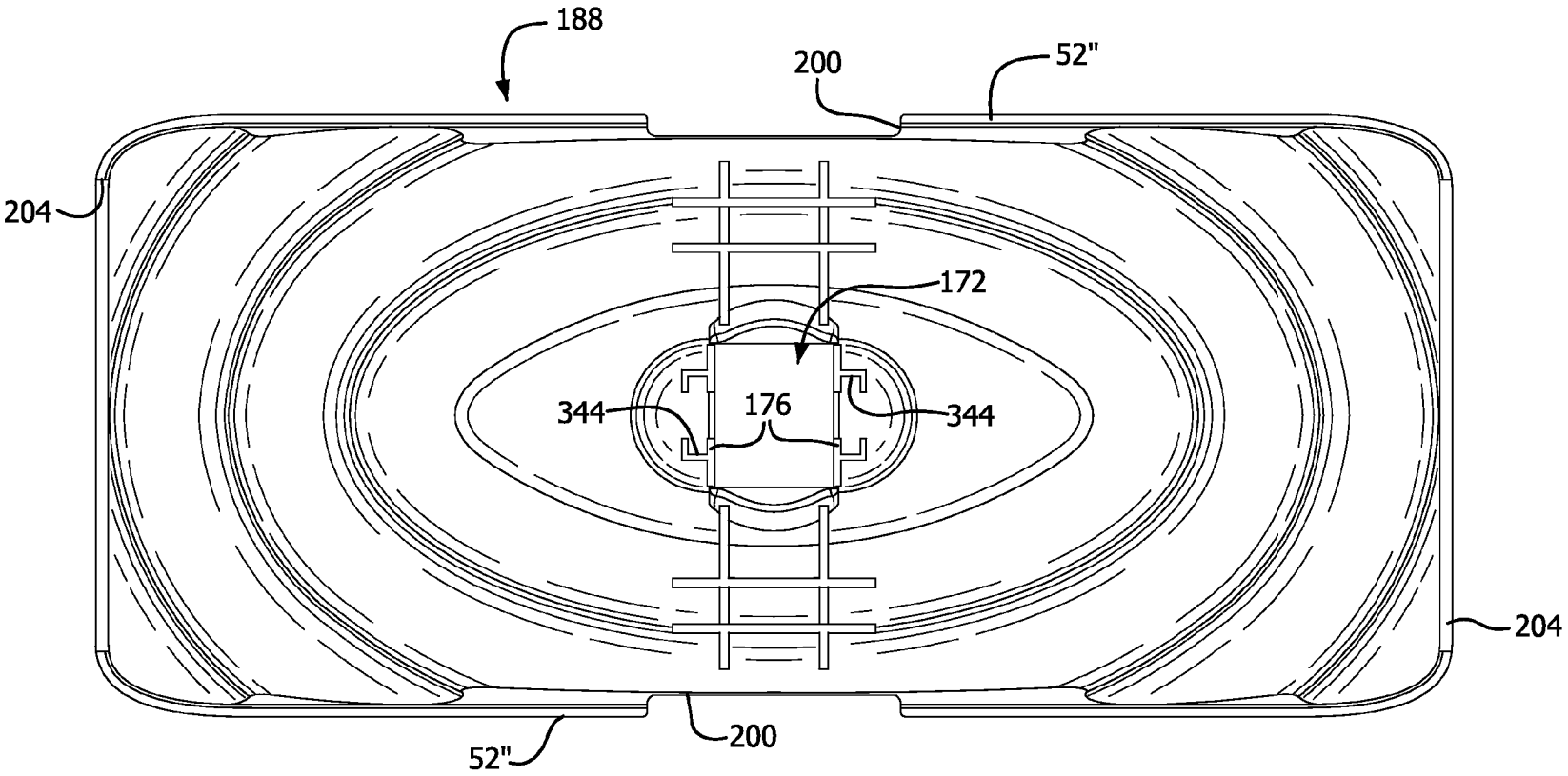
FIG. 18 is a bottom view of a top portion of a main panel of the cleaning tool shown in FIG. 12.
Figure 19:
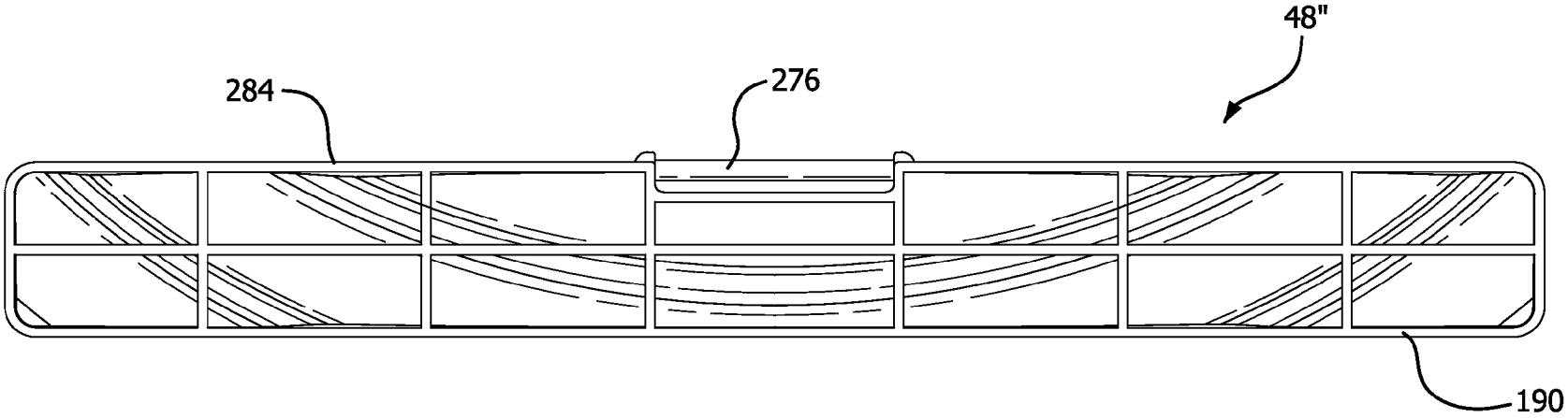
FIG. 19 is a bottom view of a side panel of the cleaning tool shown in FIG. 12.
Figure 20:
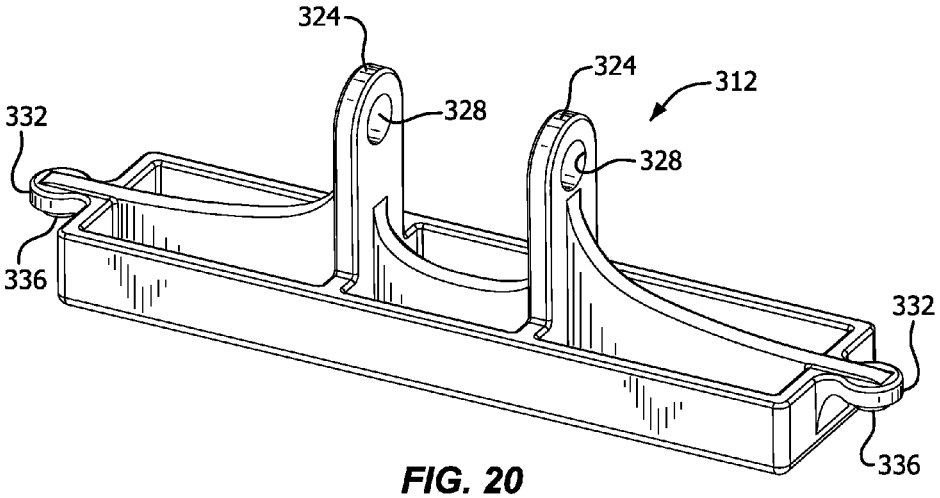
FIG. 20 is a top perspective view of a scrubber base of the cleaning tool shown in FIG. 12.
Figure 21:
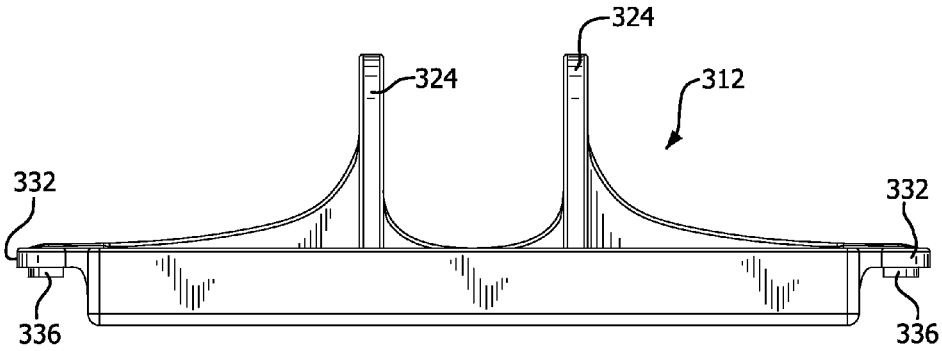
FIG. 21 is a side view of the scrubber base shown in FIG. 20.
Figure 22:
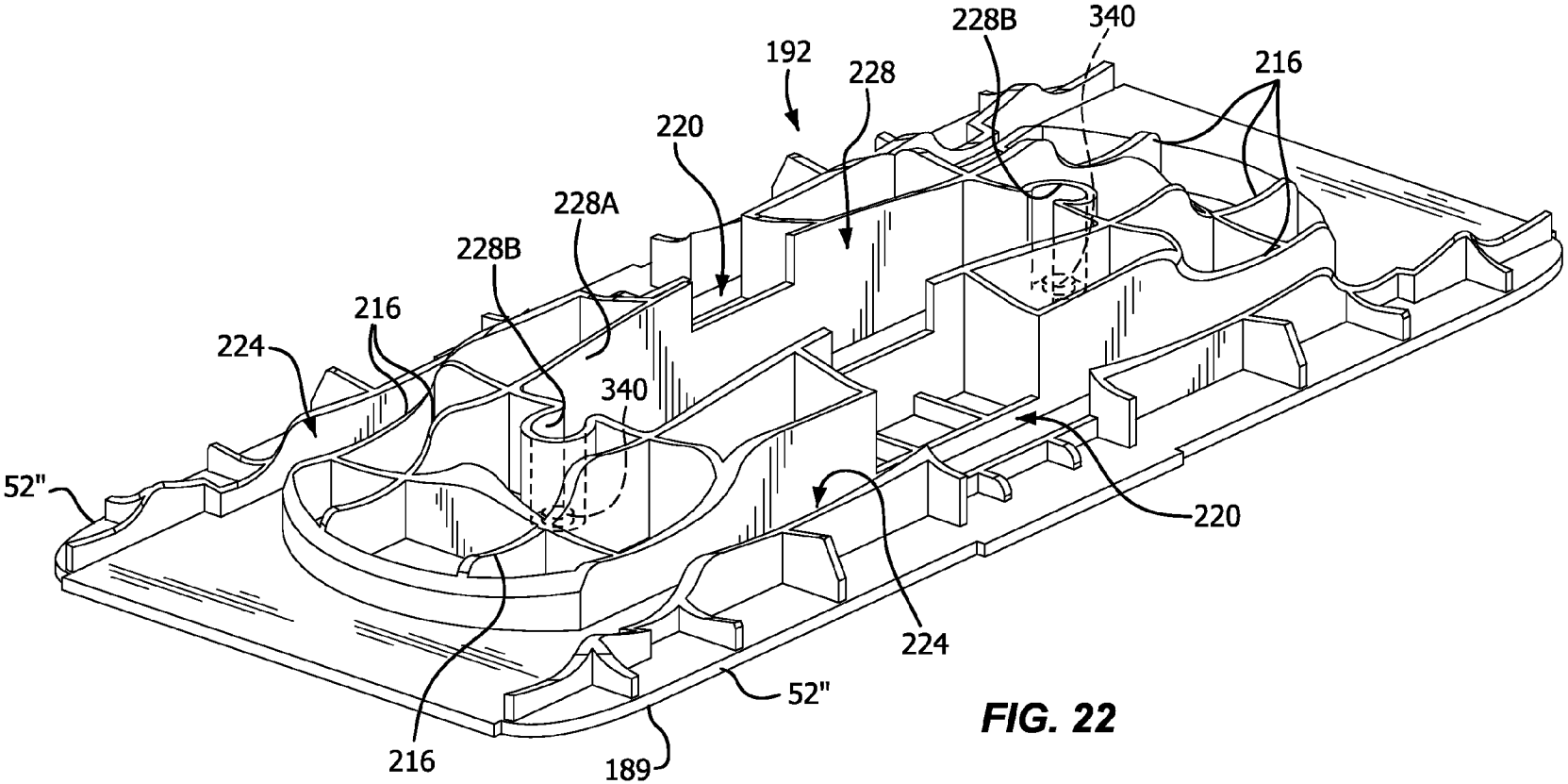
FIG. 22 is a top perspective view of a base of the main panel of the cleaning tool shown in FIG. 12.
Figure 23:
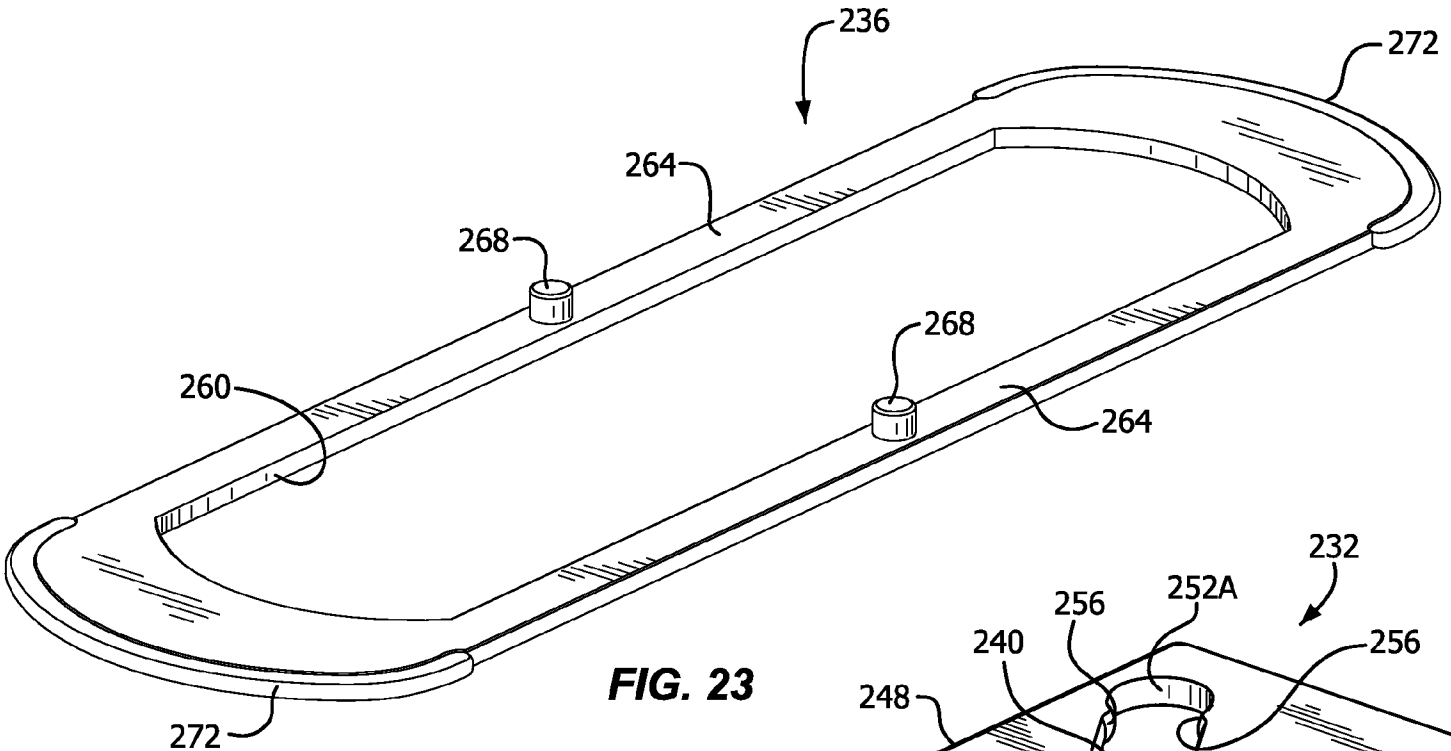
FIG. 23 is a top perspective view of an actuator of the cleaning tool shown in FIG. 12.
Figure 24:
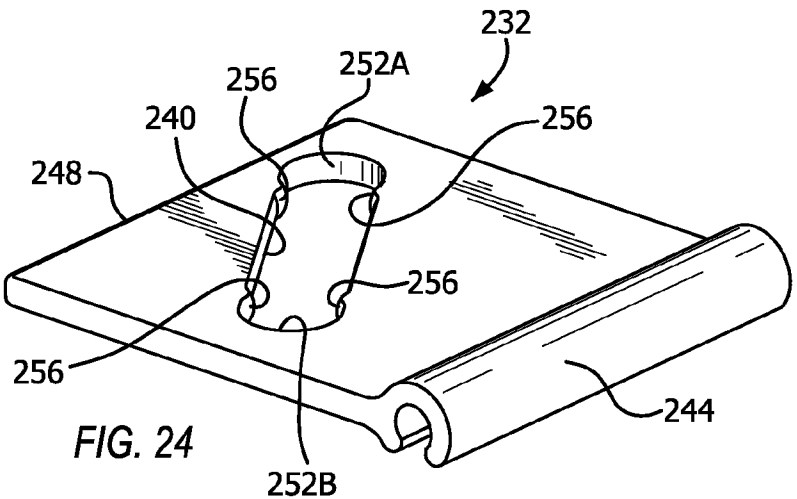
FIG. 24 is a top perspective view of a slide plate of the cleaning tool shown in FIG. 12.
Figure 25:
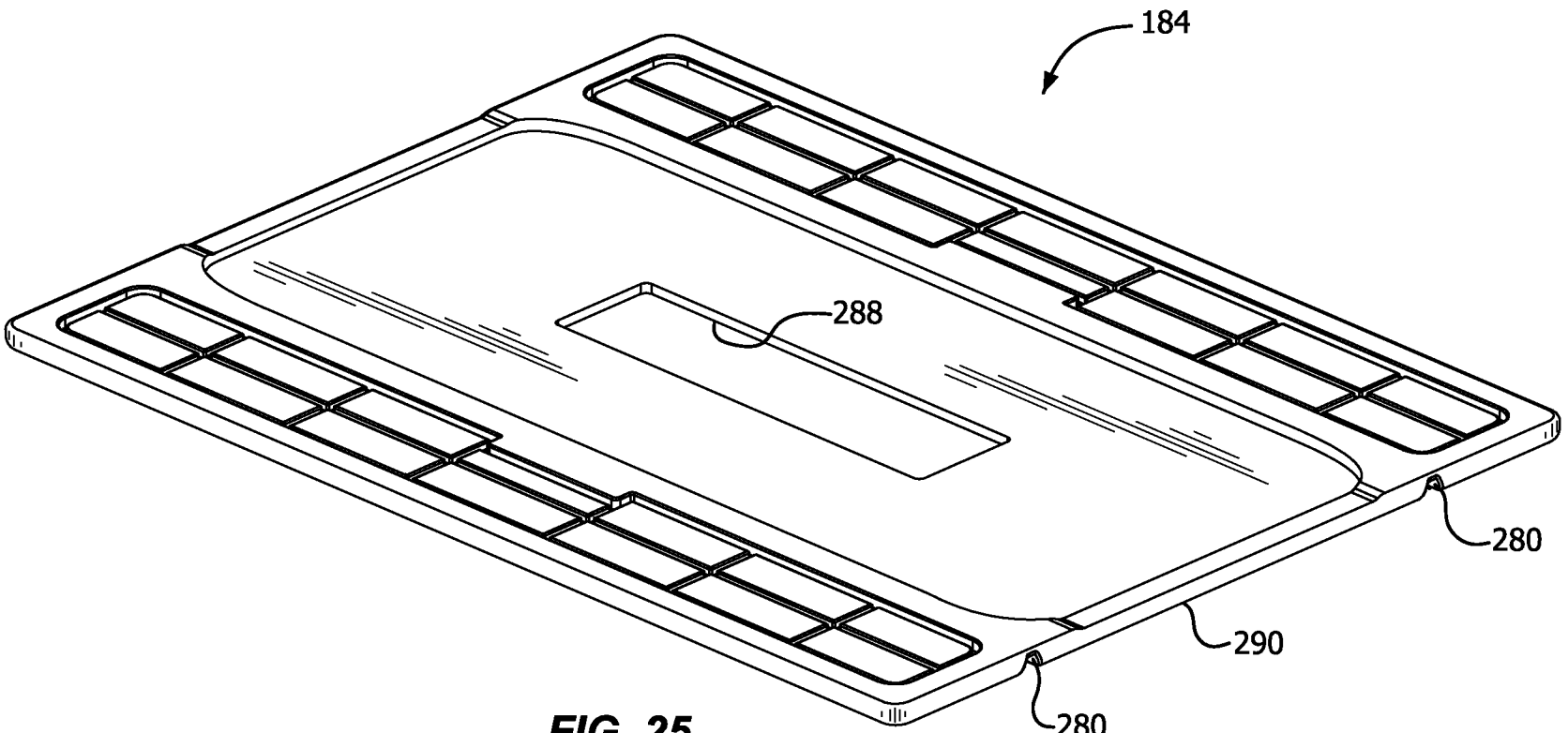
FIG. 25 is a top perspective view of a pad of the cleaning tool shown in FIG. 12.

With particular reference to FIGS. 14 and 15, cleaning head 32" includes a plurality of connectors 60" for removably coupling a cleaning implement 40" to cleaning head 32". A wide variety of cleaning implements 40" (see e.g. FIG. 14) may be secured to cleaning head 32" to collect dirt, debris, or other unwanted elements present on a surface to be cleaned.

For example, cleaning implements 40" may include a wide variety of cleaning wipes, sheets, or cloths such as, for example, dry disposable sheets, wet and dry microfiber cloths, pre-moistened disposable cleaning sheets, etc. In the illustrated exemplary embodiment, connectors 60" are hooks of a hook-and-loop type fastener. Such hooks are effective at latching onto the materials typically used for making cleaning implements 40". In other exemplary embodiments, connectors 60" may comprise different configurations and may comprise different forms such as, for example, adhesives, a plurality of pie-shaped resilient movable tabs arranged generally in a circular shape for grasping cleaning implement 40", or any other type of connector. Connectors 60" are disposed at various locations on a bottom surface 290 of pad 184. In the illustrated exemplary embodiment, a first connector 60" is disposed near a first side outer edge 294 (see FIG. 14) of pad 184, a second connector 60" is disposed near a second side outer edge 296 (see FIG. 14) of pad 184, a third connector 60" is disposed near a first side edge 298 (see FIG. 14) of scrubber opening 288, and a fourth connector 60" is disposed near a second side edge 300 (see FIG. 14) of scrubber opening 288. The illustrated number and configuration of connectors 60" are for exemplary purposes only and, alternatively, cleaning head 32" may include other numbers and configurations of connectors 60" for removably coupling a cleaning implement 40" to cleaning head 32!I and be within the intended spirit and scope of the present invention. In the illustrated exemplary embodiment, pad 184 defines connector recesses 304 (see FIG. 14) in which connectors 60" are positioned and coupled to pad 184, such as by adhesive. In other exemplary embodiments, pad 184 may not include such connector recesses and, in such embodiments, connectors 60" may then be coupled to a flat bottom surface 290 of pad 184. Pad 184 additionally includes a plurality of projections 308 on bottom surface 290 thereof, thereby providing a texture to a bottom surface of cleaning head 32". Cleaning implements 40" secured to cleaning head 32" will contact bottom surface 290 of pad 184.

With particular reference to FIGS. 13-18 and 20-22, scrubber assembly 180 includes a scrubber base 312, a connecting member 316, a scrubber 292, and a pair of biasing members 320. In the exemplary embodiment, scrubber base 312 is generally rectangular and includes a pair of upward extending flanges 324, with each flange 324 including an aperture 328 therethrough, and a pair of support arms 332, with one arm 332 extending from a first end of scrubber base 312 and a second arm 332 extending from an opposing second end of scrubber base 312. Each support arm 332 includes a downwardly extending projection 336 for supporting a top end of a respective one of biasing members 320. Connecting member 316 is coupled to a bottom surface of scrubber base 312 and is adapted to also couple to a top surface of scrubber 292, thereby coupling scrubber 292 to scrubber base 312. Connecting member 316 may couple to the bottom surface of scrubber base 312 in any of a large variety of manners including, for example, adhering, welding, unitarily forming, fastening, or any other form of bonding. In addition, connecting member 316 may secure to the top surface of scrubber 292 in any of a large variety of manners including, for example, hooks of a hook-and-loop type fastener, other types of fasteners, adhering, bonding, etc. In some exemplary embodiments, scrubber 292 is removably connected to connecting member 316 to facilitate removal and replacement of scrubber 292. Alternatively, scrubber 292 could be connected directly to the bottom surface of scrubber base 312 without the need for connecting member 316.

With continued reference to FIGS. 13-18 and 20-22, scrubber assembly 180 is supported within main panel 44". Base 192 of main panel 44" defines scrubber receptacle 228, which includes a main receptacle 228A and a pair of biasing member receptacles 228B, one of which is on each of opposing ends of main receptacle 228A. Scrubber base 312, connecting member 316, and scrubber 292 are positioned within main receptacle 228A and support arms 332 of scrubber base 312 are positioned in respective biasing member receptacles 228B. Biasing members 320 are positioned within biasing member receptacles 228B between support arms 332 and a bottom surface of receptacles 228B. Projections 336 extend into tops of central openings of biasing members 320 to support biasing members 320 from above and projections 340 extending upward from bottom surfaces of biasing member receptacles 228B extend into bottoms of central openings of biasing members 320 to support biasing members 320 from below. In this position, a bottom surface 348 of scrubber 292 is aligned with opening 288 in pad 184. Upward extending flanges 324 of scrubber base 312 extend upward into flange receptacles 344 defined in a bottom of top portion 188 of main panel 44". Apertures 328 defined in flanges 324 align with slots 176 defined in top portion 188 and slots 176 are adapted to receive swivel projections 168.

Now that the structure of cleaning tool 20" has been described, operation of cleaning tool 20" will be described herein.

With reference to FIGS. 12-14, cleaning head 32" is illustrated in its flat position. In the flat position, cleaning head 32" has a first cleaning area defined by a width W1" between outer edges of pad 184 (see FIG. 13) and a length L1" along the longitudinal extent of pad 184 of cleaning head 32" (see FIG. 13). In the illustrated exemplary embodiment, this first configuration of cleaning head 32" provides the largest possible cleaning area.

Figure 26:
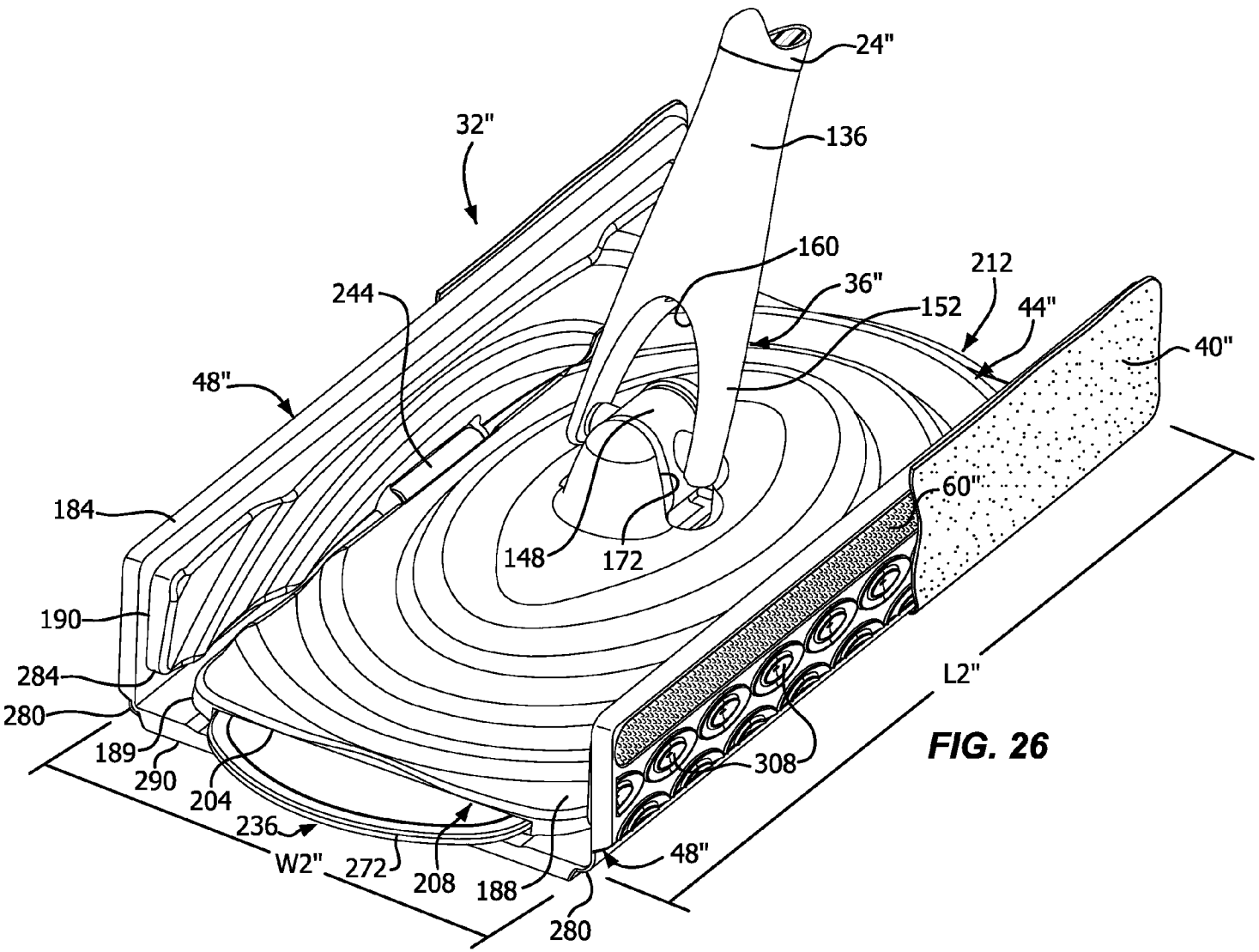
FIG. 26 is a top front perspective view of the cleaning tool shown in FIG. 12 with the cleaning tool shown in an upward pivoted position.
Figure 27:
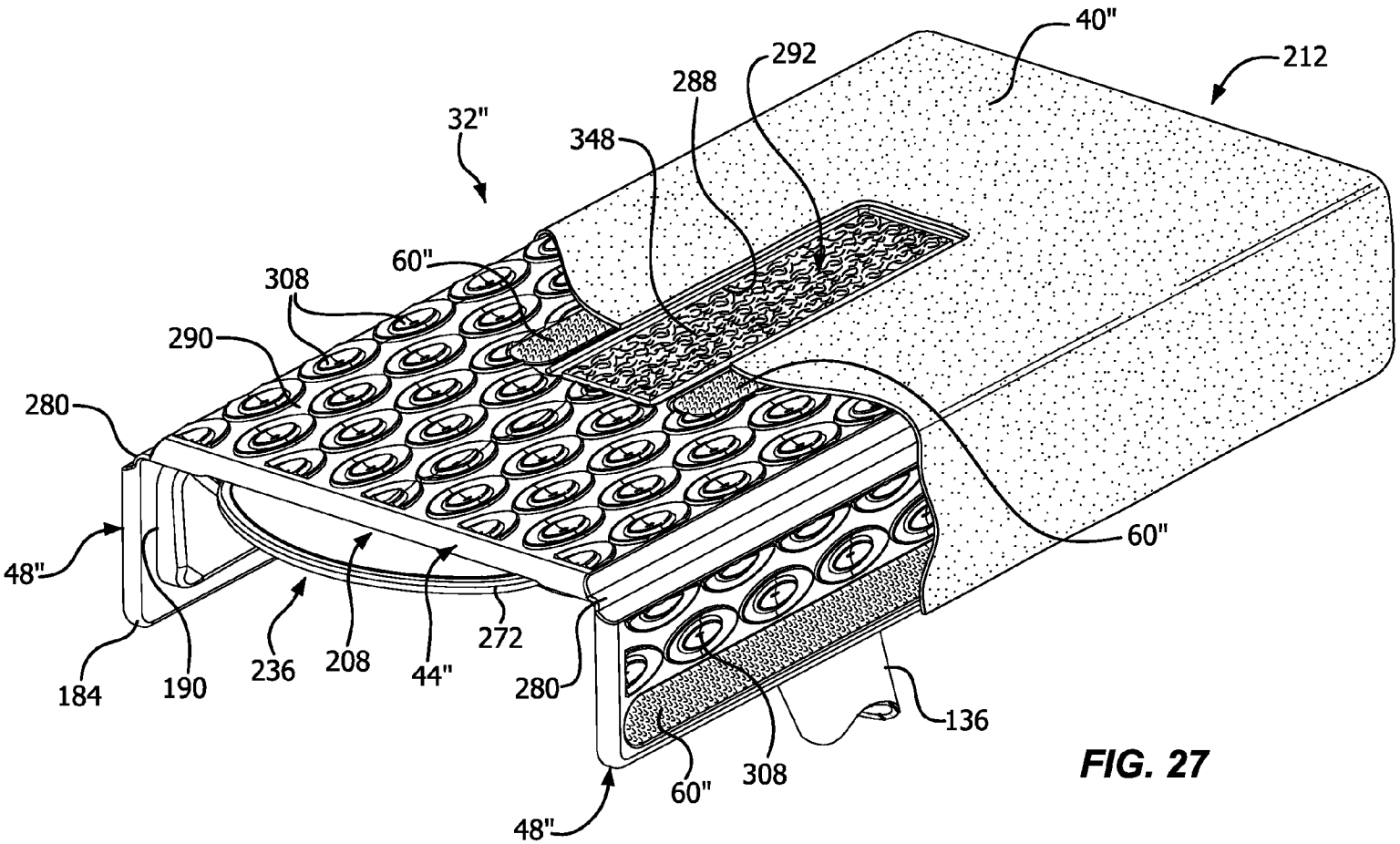
FIG. 27 is a bottom front perspective view of the cleaning tool shown in FIG. 26.

Cleaning head 32" is movable between the flat position illustrated in FIGS. 12 14 and an upward pivoted position illustrated in FIGS. 26 and 27. In the upward pivoted position, cleaning head 3" has a second cleaning area defined by a width W2" between recesses 280 of pad 184 (see FIG. 26) and a length L2" along the longitudinal extent of pad 184 of cleaning head 32" (sec FIG. 26). In the illustrated exemplary embodiment, this second configuration of cleaning head 32" provides the smallest possible cleaning area.

To move cleaning head 32" from the flat position illustrated in FIGS. 12-14 to the upward pivoted position illustrated in FIGS. 26 and 27, actuator 236 must be moved from the position illustrated in FIGS. 12-14, in which a rear end of actuator 236 projects from rear edge 212 of main panel 44", to the position illustrated in FIGS. 26 and 27, in which a front end of actuator 236 projects from front edge 208 of main panel 44". Actuator 236 may be moved in a variety of manners including, for example, by pushing it with a user's hand or foot, pushing actuator 236 against a vertical surface such as, for example, a wall, a base board, a vertical piece of furniture, etc., or any of a variety of other manners. Upon movement of actuator 236, side portions 264 of actuator 236 slide within actuator channels 224, thereby moving actuator projections 268 forward. Forward movement of projections 268 causes projections 268 to move out of capture portions 252A of slots 240 associated with the flat position and move along slots 240 toward capture portions 252B at the other end of slots 240. As projections 268 move through slots 240, slide plates 232 are drawn inward toward a center of main panel 44", which causes coupling members 244 pull on hinge posts 276 of side panels 48", which rotate within coupling members 244. Because base 192 and side panels 48" are coupled to pad 184, side panels cannot move laterally toward base 192 and the pulling of hinge posts 276 by coupling members 244 causes side panels 48" to pivot upward about recesses 280 defined in pad 184. Cleaning head 32" is secured in the upward pivoted position when actuator projections 268 are captured in capture portions 252B associated with the upward pivoted position. Capture portions 252B ensure that cleaning head 32" is retained in the upward pivoted position until actuator 236 is moved to return cleaning head 32" to the flat position. To return cleaning head 32" to the flat position, actuator 236 is moved from the position illustrated in FIGS. 26 and 27 to the position illustrated in FIGS. 12-14. Movement of actuator 236 in this way moves actuator projections 268 out from capture portions 252B associated with the upward pivoted position, along slot 240, and into capture portions 252A associated with the flat position. This movement also causes side panels 48" to pivot downward about recesses 280 to their flat positions. Cleaning head 32" is secured in the flat position when actuator projections 268 are captured in capture portions 252A associated with the flat position. Capture portions 252A ensure that cleaning head 32" is retained in the flat position until actuator 236 is moved to return cleaning bead 32" to the upward pivoted position. These steps may be repeated as desired to move cleaning head 32" between the flat position and the upward pivoted position.

It will be understood that, while described in connection with the exemplary embodiment as slide plate(s), the side panel operating member(s) 232 may be configured as one or more links that are operably connected to actuator 236 and pivotally connected to the side panel(s). Moreover, while actuator 236 has been described as a linearly reciprocating member, it may also be constructed and arranged to be a pivoting element which, in association with appropriately arranged plate(s) (or link(s)), actuator projection(s) and arcuate slot(s), performs equally well to pivot the side panel(s) from their flat to upwardly pivoted positions, and vice versa.

Figure 28:
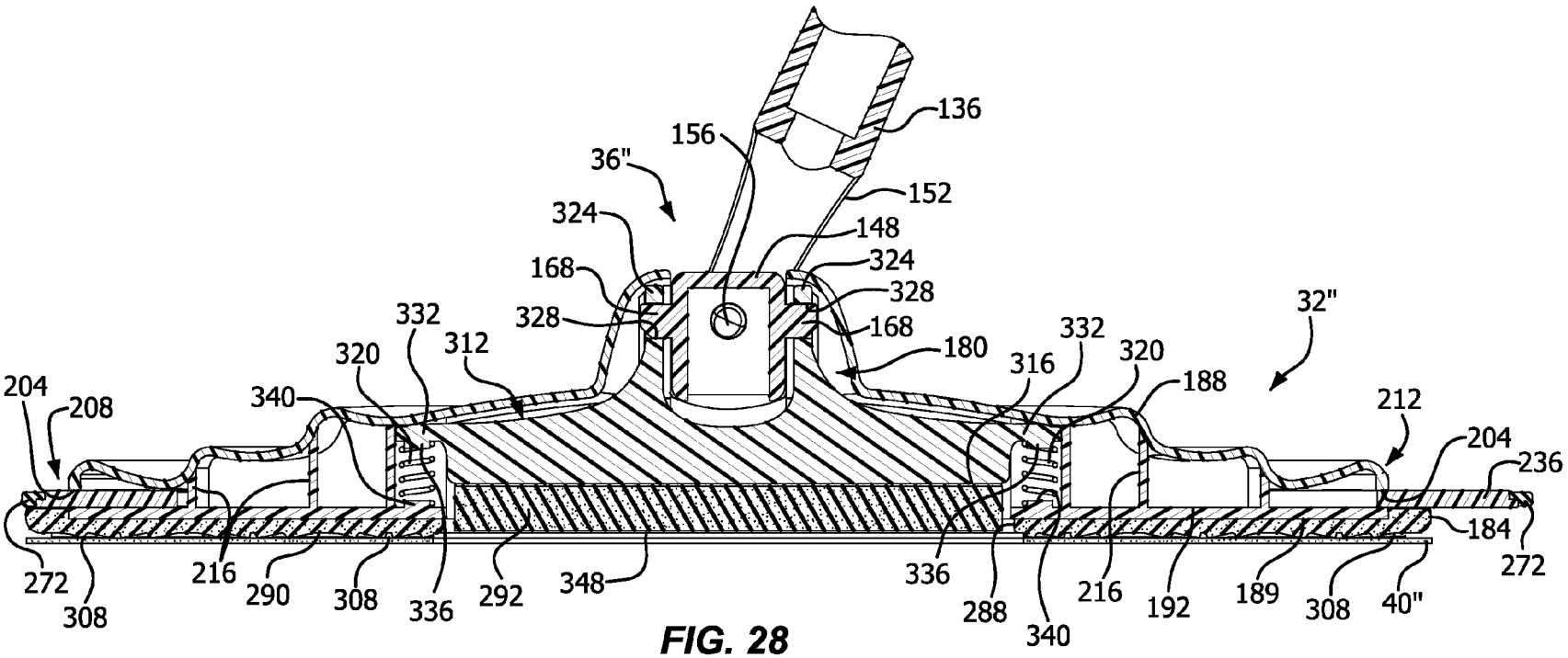
FIG. 28 is a cross-sectional view of the cleaning tool taken along line 28-28 in FIG. 13, the cleaning tool is shown with a scrubber assembly in a retracted storage position.
Figure 29:
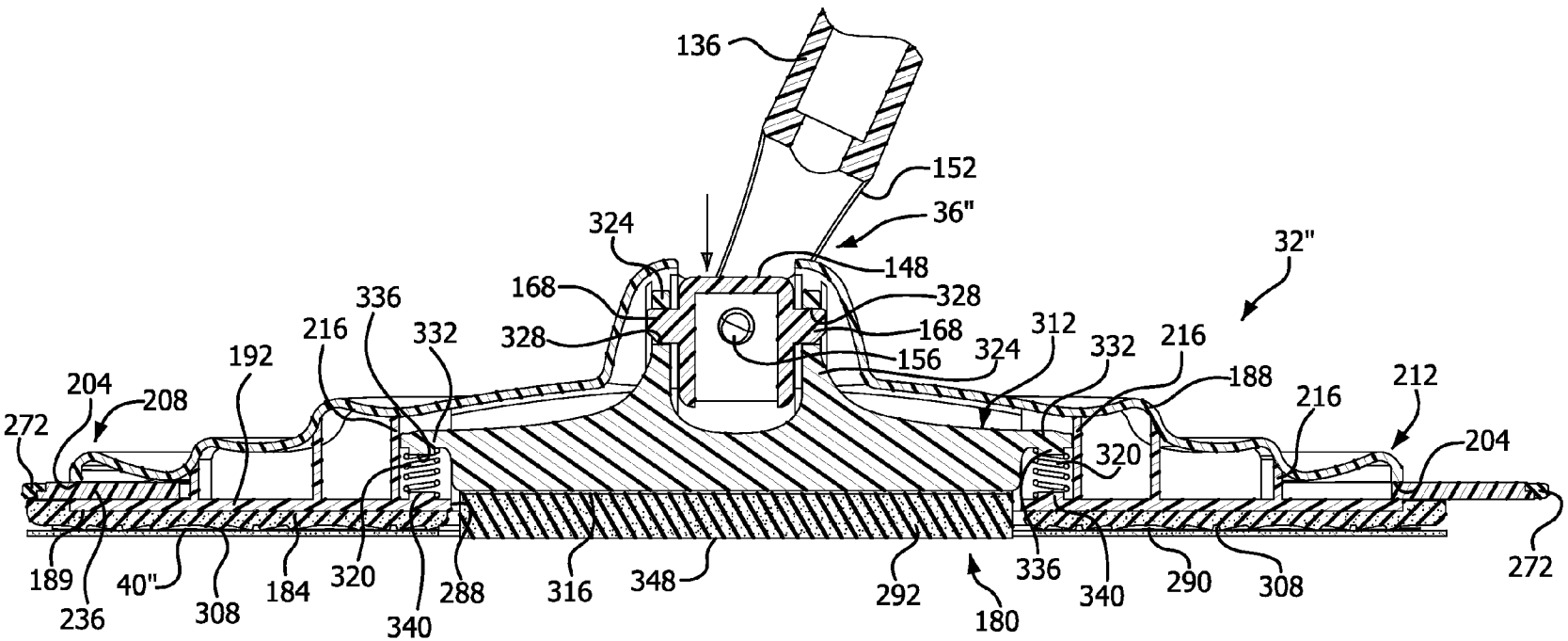
FIG. 29 is a cross-sectional view similar to FIG. 28 with the scrubber assembly in an extended operating position.

Referring now to FIGS. 28 and 29, scrubber assembly 180 may be moved between a retracted storage position (see FIG. 28) and an extended operating position (see FIG. 29) to provide a user with the option to use cleaning head 32" to wipe a surface (i.e., only clean the surface with cleaning implement 40") or to scrub a surface (i.e., clean a surface by deploying scrubber 292 to scrub the surface). In the storage position, bottom surface 348 of scrubber 292 is positioned above bottom surfaces of pad 184 and cleaning implement 40" to prevent scrubber 292 from engaging a surface to be cleaned. In this storage position, the surface to be cleaned is solely wiped with cleaning implement 40". Scrubber 292 is continuously biased upward toward its storage position by biasing members 320. To move scrubber 292 to its operating position, a user must push down on handle 24", thereby applying pressure to universal joint 36", which in turn applies downward force to scrubber assembly 180. As can be seen in FIGS. 15 and 29, swivel projections 168 extend through vertical slots 176 defined in top portion 188 of main panel 44" and insert into apertures 328 defined in flanges 324 of scrubber base 312. Slots 176 inhibit lateral movement of swivel 148 and scrubber base 312, while allowing vertical movement of swivel 148 and scrubber base 312 by not inhibiting vertical movement of swivel projections 168 extending through slots 176. With particular reference to FIG. 29, a sufficiently strong downward force on scrubber assembly 180 overcomes the upward bias of biasing members 320, thereby causing downward movement of scrubber assembly 180 and compression of biasing members 320. Downward movement of scrubber assembly 180 positions bottom surface 348 of scrubber 292 below bottom surfaces of pad 184 and cleaning implement 40", thereby engaging scrubber 292 with a surface to be cleaned. After a user determines that scrubbing is no longer required, the user removes the sufficiently strong downward force on handle 24", which allows biasing members 320 to bias scrubber assembly 180 in an upward direction back to its storage position. These steps may be repeated as desired to facilitate selective scrubbing of a surface.

It should be understood that scrubber assembly 180 may be moved between its storage position and operating position when cleaning head 32" is in both the flat position and the upward pivoted position.

The various cleaning head configurations and associated cleaning areas provide a user with the ability to choose the cleaning area that best accommodates the environment and conditions in which cleaning tool 20" will be used. For example, in environments having a wide open floor surface without many obstacles, a user may desire to use cleaning head 32" in its first configuration and largest cleaning area, which would allow a user to cover the wide open environment in an efficient manner. Also, for example, in environments having many obstacles and narrow distances between obstacles, a user may desire to use cleaning head 32" in its second configuration and smallest cleaning area, which would allow a user to more easily manipulate cleaning head 32" around and between the obstacles on the floor surface.

The foregoing description has been presented for purposes of illustration and description, and is not intended to be exhaustive or to limit the invention to the precise form disclosed. The descriptions were selected to explain the principles of the invention and their practical application to enable others skilled in the art to utilize the invention in various embodiments and various modifications as are suited to the particular use contemplated. Although particular constructions of the present invention have been shown and described, other alternative constructions will be apparent to those skilled in the art and are within the intended scope of the present invention.

What is claimed is:

1. A cleaning head for a cleaning tool comprising:

a main panel;

at least one side panel pivotally coupled to said main panel;

means for facilitating movement of said at least one side panel relative to said main panel upon engagement of said at least one side panel with a non-horizontal surface, wherein said means for facilitating movement comprises at least one ramp member; and means for biasing said at least one side panel toward a flat position in response to upward force exerted on said at least one side panel.

2. The cleaning head of claim 1 wherein said at least one side panel is substantially coplanar with said main panel when in said flat position.

3. The cleaning head of claim 1 wherein said means for biasing comprise at least one elastic member.

4. A cleaning head for a cleaning tool comprising:

a main panel;

at least one side panel pivotally coupled to said main panel;

means for facilitating movement of said at least one side panel relative to said main panel upon engagement of said at least one side panel with a non-horizontal surface, wherein said means for facilitating movement comprises at least one ramp member; and means for releasably securing said at least one side panel in an upwardly pivoted position relative to said main panel.

5. The cleaning head of claim 4 wherein said means for releasably securing comprises at least one magnet carried by one of said main panel and said at least one side panel and a metallic member carried by the other of said main panel and said at least one side panel.

6. A cleaning head for a cleaning tool comprising:

a main panel;

at least one side panel pivotally coupled to said main panel; and means for releasably securing said at least one side panel in an upwardly pivoted position relative to said main panel, wherein said means for releasably securing comprises a first set of spaced projections carried by said at least one side panel and a second set of spaced projections carried by said main panel, said first set of spaced projections being offset with respect to said second set of spaced projections whereby said first and second sets of projections interlace and provide an interference fit with each other when said at least one side panel is pivoted upwardly.

7. The cleaning head of claim 6 further comprising means for uncoupling said at least one side panel from an upwardly pivoted position relative to said main panel.

8. The cleaning head of claim 7 wherein said uncoupling means comprise uncoupling finger means for contacting said at least one side panel and overcoming said interference fit between said first and second sets of projections.

9. The cleaning head of claim 8 wherein said uncoupling means further comprise a first ramped surface and said uncoupling finger means includes a second ramped surface complementary to and aligned with said first ramped surface, whereby force applied by said first ramped surface against said second ramped surface causes said finger means to contact said at least one side panel and overcome said interference fit between said first and second sets of projections.

10. A cleaning tool comprising a cleaning head according to claim 9.

11. The cleaning tool of claim 10 further comprising a handle connected to said cleaning head, whereby depression of said handle causes said finger means to contact said at least one side panel and overcome said interference fit between said first and second sets of projections.

12. The cleaning tool of claim 11 further comprising a universal joint connecting said handle to said cleaning head.

13. A cleaning head for a cleaning tool comprising:

a main panel;

at least one side panel pivotally coupled to said main panel; and means for pivoting said at least one side panel relative to said main panel, wherein said means for pivoting comprises:

a moveable actuator carried by said main panel;

at least one side panel operating member connected to said actuator and pivotally connected to said at least one side panel; and a slot carried by one of said actuator and said at least one side panel operating member and a projection carried by the other of said actuator and said at least one side panel operating member, said projection being receivable and moveable in said slot.

14. The cleaning head of claim 13 wherein said slot includes a first projection capture portion for releasably retaining said at least one side panel in an upward pivoted position.

15. The cleaning head of claim 14 wherein said slot includes a second projection capture portion for releasably retaining said at least one side panel in a flat position.

16. A cleaning head for a cleaning tool comprising:

a main panel;

at least one side panel pivotally coupled to said main panel;

a retractable scrubber;

a means for biasing said scrubber into a retracted position; and a cleaning head further comprising a handle connected to said cleaning head, whereby depression of said handle overcomes said biasing means such that said scrubber projects from a lower surface of said cleaning head.

17. The cleaning tool of claim 16 further comprising a universal joint connecting said handle to said cleaning head.

* * * * *